US008525772B2

(12) United States Patent
Tanaka et al.

(10) Patent No.: US 8,525,772 B2
(45) Date of Patent: Sep. 3, 2013

(54) LCOS SPATIAL LIGHT MODULATOR

(75) Inventors: Hiroshi Tanaka, Hamamatsu (JP); Takashi Inoue, Hamamatsu (JP); Munenori Takumi, Hamamatsu (JP); Norihiro Fukuchi, Hamamatsu (JP); Naoya Matsumoto, Hamamatsu (JP)

(73) Assignee: Hamamatsu Photonics K.K., Kamamatsu (JP)

( * ) Notice: Subject to any disclaimer, the term of this patent is extended or adjusted under 35 U.S.C. 154(b) by 1114 days.

(21) Appl. No.: 12/448,287

(22) PCT Filed: Jan. 18, 2008

(86) PCT No.: PCT/JP2008/050610

§ 371 (c)(1),
(2), (4) Date: Jun. 16, 2009

(87) PCT Pub. No.: WO2008/088043

PCT Pub. Date: Jul. 24, 2008

(65) Prior Publication Data

US 2010/0026620 A1 Feb. 4, 2010

(30) Foreign Application Priority Data

Jan. 19, 2007 (JP) ..... 2007-010780

(51) Int. Cl.

| | |
|---|---|
| ***G09G 3/36*** | (2006.01) |
| ***G09G 3/16*** | (2006.01) |
| ***G09G 3/34*** | (2006.01) |

(52) U.S. Cl.

USPC ..... 345/100; 345/48; 345/84

(58) Field of Classification Search

USPC ..... 345/48–54, 84–107; 377/57–64; 365/78

See application file for complete search history.

(56) References Cited

U.S. PATENT DOCUMENTS

| | | | |
|---|---|---|---|
| 5,442,372 | A | 8/1995 | Shiki |
| 5,625,376 | A | 4/1997 | Maekawa |
| 2002/0094846 | A1 | 7/2002 | Kishimoto et al. |
| 2005/0088622 | A1 | 4/2005 | De Vaan et al. |
| 2005/0248556 | A1 | 11/2005 | Yoshinaga et al. |

FOREIGN PATENT DOCUMENTS

| | | |
|---|---|---|
| JP | A-5-216008 | 8/1993 |
| JP | A 6-202595 | 7/1994 |
| JP | A 7-20816 | 1/1995 |
| JP | A 8-54601 | 2/1996 |
| JP | A-2000-194308 | 7/2000 |
| JP | A 2000-322034 | 11/2000 |
| JP | A 2001-356744 | 12/2001 |
| JP | A-2002-204297 | 7/2002 |
| JP | A-2005-517365 | 6/2005 |
| JP | A 2005-189758 | 7/2005 |
| JP | B2 3722371 | 9/2005 |

OTHER PUBLICATIONS

Jul. 19, 2012 Office Action issued in Japanese Patent Application No. 2008-554092 (with translation).

*Primary Examiner* — Srilakshmi K Kumar
(74) *Attorney, Agent, or Firm* — Oliff & Berridge, PLC

(57) ABSTRACT

The display area selection circuit selects a desired display area. The signal generating circuit sets a period of each shift signal generated while the selection position of the pixel diode is between the shift start position and the display start position shorter than a period of each shift signal generated while the selection position of the pixel diode is between the display start position and the display end position.

8 Claims, 20 Drawing Sheets

LCOS SPATIAL LIGHT MODULATOR

TECHNICAL FIELD

The present invention relates to an LCoS spatial light modulator.

BACKGROUND ART

A spatial light modulator (SLM) using liquid crystal on silicon (LCoS) is well known in the art. When a voltage is applied to a pixel electrode, liquid crystal molecules in the LCoS rotate into an orientation orthogonal to the substrate, modifying the phase modulation amount of incident light. A higher frame rate than that in LCoS display applications is required to produce a high-performance LCoS spatial light modulator.

In one such LCoS display device, the display area of the display device is divided into a plurality of smaller regions and portions of images in adjacent regions along a borderline dividing the regions are displayed simultaneously (see Patent Reference 1, for example). A method has also been proposed for a simple matrix type liquid crystal display device by which the display area is divided into a plurality of regions and pixels in each region are driven simultaneously to reduce power consumption of the liquid crystal display device (see Patent Reference 2, for example). Another proposed matrix type liquid crystal display device divides the display area at arbitrary positions (see Patent Reference 3, for example).

Patent Reference 1: Japanese patent application publication No. 2005-189758

Patent Reference 2: Japanese patent application publication No. 2001-356744

Patent Reference 3: Japanese Patent No. 3722371

DISCLOSURE OF THE INVENTION

Problems to be Solved by the Invention

Temporal fluctuations in light modulation occur in SLMs using liquid crystal. These fluctuations may occur when an AC signal is applied to the liquid crystal to produce a potential difference therein, when the voltage applied to individual pixel electrodes changes within a single frame due to charge leaking from the pixel capacitor, or when impurities and the like in the liquid crystal affect modulation. Temporal fluctuations are not a major problem when using an SLM in a display application due to the inherent temporal filtering of the human eye, but can often be a problem in measurement applications. The fluctuations can be suppressed by increasing the frame rate, i.e., shortening the time of one frame. Here, one frame time is defined as the product of the charge accumulation time required for one pixel to accumulate charge and the number of pixels, plus the sum of the horizontal synchronization periods and the vertical synchronization period. Since the lower limit of the charge accumulation time for one pixel is determined by the circuit structure, it is difficult to reduce the frame time.

According to the method described in Patent Reference 1, it is necessary to increase the number of signal lines to increase the frame rate, but the number of signal lines that can be connected is limited by the circuit structure. Therefore, this method does not sufficiently reduce fluctuations in light modulation to the degree required for using an LCoS display device in measurement applications.

According to the method of Patent Reference 2, the display area of a simple matrix liquid crystal display device is divided into a plurality of areas that are driven independently. This method partially drives parts of adjacent display areas along a borderline dividing the display areas. This method of partial display driving reduces power consumption while avoiding display abnormalities along the dividing borderline. However, it is not likely that this liquid crystal display device can achieve a greater image quality than that of an active matrix type display device due to cross talk and the like occurring in the simple matrix display device. The method of increasing the frame rate described in Patent Reference 2 will not be described in this specification because a higher frame rate under partial driving would hinder efforts to reduce power consumption and is thus undesirable. Therefore, temporal fluctuations in light modulation occur in the simple matrix liquid crystal display device of this example, and thus the display device cannot achieve the image quality required for an SLM used in measurement applications.

The method described in Patent Reference 3 is also designed to reduce power consumption through partial display driving similar to that described in Patent Reference 2 and does not attempt to increase the frame rate. This display device also uses shift registers with a memory function to specify a start position for partial driving, resulting in a more complex shift register construction. Further, it is necessary to preset registers prior to displaying an image in order to specify the start position, making it impossible to dynamically modify the position for partial driving.

An object of the present invention is to provide an LCoS spatial light modulator capable of improving image quality by achieving a high frame rate during partial driving, and capable of dynamic partial driving in desired areas through a simple circuit construction.

Arrangement Solving the Problem

In order to solve the above problem, an LCoS spatial light modulator has a plurality of pixel diodes, a signal generating circuit, a pixel selection circuit, and a display area selection circuit. The plurality of pixel diodes is arranged two-dimensionally and defines a modulation area. The signal generating circuit generates a shift signal and a reset signal. The pixel selection circuit selects a pixel diode based on the shift signal and the reset signal and inputs a data signal into the selected pixel. The display area selection circuit selects a desired display area from the modulation area. The modulation area is divided into a plurality of divided modulation areas by at least one borderline. The display area selection circuit selects a display area including at least part of at least one borderline from the modulation area. The selected display area includes two divided display areas that are provided in two divided modulation areas disposed each side of the borderline. Each divided display area includes a corresponding display start position and a corresponding display end position. For each of the plurality of divided modulation areas, the pixel selection circuit sequentially shifts a selection position of the pixel diode from a prescribed shift start position based on the shift signals and returns the selection position of the pixel diode toward the prescribed shift start position based on the reset signal. For each of the at least two divided modulation areas corresponding to the at least two divided display areas, the signal generating circuit sequentially generates the shift signals for shifting the selection position of the pixel diode from the shift start position corresponding to the each of the at least two divided modulation areas toward a shift end position corresponding to the each of the at least two divided modulation areas via the display start position corresponding to the each of the at least two divided modulation areas. The signal generating circuit halts generation of the shift signals and generates the reset signal to return the selection position of the pixel diode to the shift start position after the selection position of the pixel diode reaches the display end position. The signal generating circuit sets a period of each shift signal generated while the selection position of the pixel diode is between the shift start position and the display start position shorter than a period of each shift signal generated while the selection position of the pixel diode is between the display start position and the display end position.

According the LCoS spatial light modulator, the signal generation circuit generates a shift signal, whose period is shorter, by the display start position in the display area and generates reset signal at end position in the display area. Thus, it possible to reduce the shift time in the modulation area other than the display area, thereby achieving a higher frame rate and reducing temporal modulation fluctuations in light modulation.

Preferably, the pixel selection circuit sets the shift start positions with respect to the two neighboring divided modulation areas as pixel diodes that are most adjacent to the borderline of the two neighboring divided modulation areas. Accordingly, the shift time to the display start position can be reduced, thereby achieving a higher frame rate and reducing temporal modulation fluctuations in light modulation.

Preferably, the LCoS spatial light modulator further includes a start position selection circuit that specifies at least one shift start position different from the prescribed shift start position. When the signal generation circuit designates the start position selection circuit, the pixel selection circuit starts shifting the selection position of the pixel diode from the shift start position specified by the start position selection circuit. The selection position of pixel is shifted from the shift start position specified by the start position selection circuit. Thus, it is possible to reduce the shift time toward the display area start position, thereby further achieving a higher frame rate and reducing temporal modulation fluctuations in light modulation.

Preferably, the LCoS spatial light modulator further includes a plurality of data lines and a plurality of scan lines that intersect the plurality of the data lines. Each pixel diode is connected to one data line and one scan line. The modulation area is divided into first and second divided modulation areas by one borderline. The one borderline is parallel to the data line. The signal generating circuit generates first and second data line shift signals, a scan line shift signal, first and second data line rest signals, and a scan line reset signal. The pixel selection circuit includes a scan line selection circuit that selects a scan line, a first data line selection circuit that selects a data line in the first divided modulation area and that inputs data into the selected data line, and a second data line selection circuit that selects a data line in the second divided modulation area and that inputs data into the selected data line. The scan line selection circuit sequentially shifts a selection position of the scan line from a prescribed scan line shift start position based on the scan line shift signals and returns the selection position of the scan line to the scan line shift start position based on the scan line reset signal. The first data line selection circuit sequentially shifts a selection position of the data line from a first data line shift start position in the first modulation area and returns the selection position of the data line to the first data line shift start position based on the first data line reset signal. The second data line selection circuit sequentially shifts a selection position of the data line from a second data line shift start position in the second modulation area and returns the selection position of the data line to the second data line shift start position based on the second data line reset signal. The first data line shift start position is a selection position of a data line that is provided in the first modulation area and that is most adjacent to the borderline. The second data line shift start position is a selection position of a data line that is provided in the second modulation area and that is most adjacent to the borderline. The display area selection circuit selects the display area that includes at least part of one borderline from the modulation area. The display area has first and second divided display areas provided in the first and second divided modulation areas. The display area includes, as the display start position, a scan line display start position, the first data line shift start position, and the second data line shift start position. The display area includes, as the display end position, a scan line display end position, a first data line display end position provided in the first divided display area, and a second data line display end position provided in the second divided display area. The signal generating circuit sequentially generates the scan line shift signals for shifting the selection position of the scan line from the scan line shift start position to the scan line display end position via the scan line display start position. The signal generating circuit sequentially generates first data shift signals for shifting the selection position of the data line in the first divided modulation area from the first data line shift start position to the first data line display end position. The signal generating circuit halts generation of the first data line shift signals and generates the first data line reset signal to return the selection position of the data line to the first data line shift start position after the selection position of the data line reaches the first data line display end position. The signal generating circuit sequentially generates second data shift signals for shifting the selection position of the data line in the second divided modulation area from the second data line shift start position to the second data line display end position. The signal generating circuit halts generation of the second data line shift signals and generates the second data line reset signal to return the selection position of the data line to the second data line shift start position after the selection position of the data line reaches the second data line display end position. The signal generating circuit halts generation of the scan line shift signals and generates the scan line reset signal to return the selection position of the scan line to the scan line shift start position after the selection position of the scan line reaches the scan line display end position, after the selection position of the data line in the first divided modulation area reaches the first data line display end position, and after the selection position of the data line in the second divided modulation area reaches the second data line display end position. The signal generating circuit sets a period of each scan line shift signal generated while the selection position of the scan line is between the scan line shift start position and the scan line display start position shorter than a period of each scan line shift signal generated while the selection position of the scan line is between the scan line display start position and the scan line display end position.

The signal generating circuit generates the scan line shift signal whose period is shorter, to the scan line display position in the display area. The signal generating circuit sends first and second data reset signals in the first and second data line display start position of the display area and send the scan line reset signal in the scan line display end area. Thus, it is possible to reduce the shift time in the modulation area other than the display area. Since the first data line shift start position and the second data line start position are set as described above, the shift time is reduced by respective display start position, thereby achieving a higher frame rate and reducing modulation fluctuations in light modulation.

Preferably, the scan line selection circuit includes a start position selection circuit that specifies a scan line shift start position different from the prescribed scan line shift start position. When the start signal generation circuit designates the start position selection circuit, the scan line selection circuit starts shifting the selection position of the scan line from the scan line shift start position specified by the start position selection circuit. The selection position of pixel is shifted from the shift start position specified by the start position selection circuit. Thus, it is possible to reduce the shift time toward the display area start position, thereby further achieving a higher frame rate and reducing modulation fluctuations in light modulation.

An LCoS spatial light modulator according to the present invention can reduce the shift time in the modulation area other than the display area, thereby further achieving a higher frame rate and reducing modulation fluctuations in light modulation.

EXPLANATION OF REFERENCE NUMBERS

Figure 1:
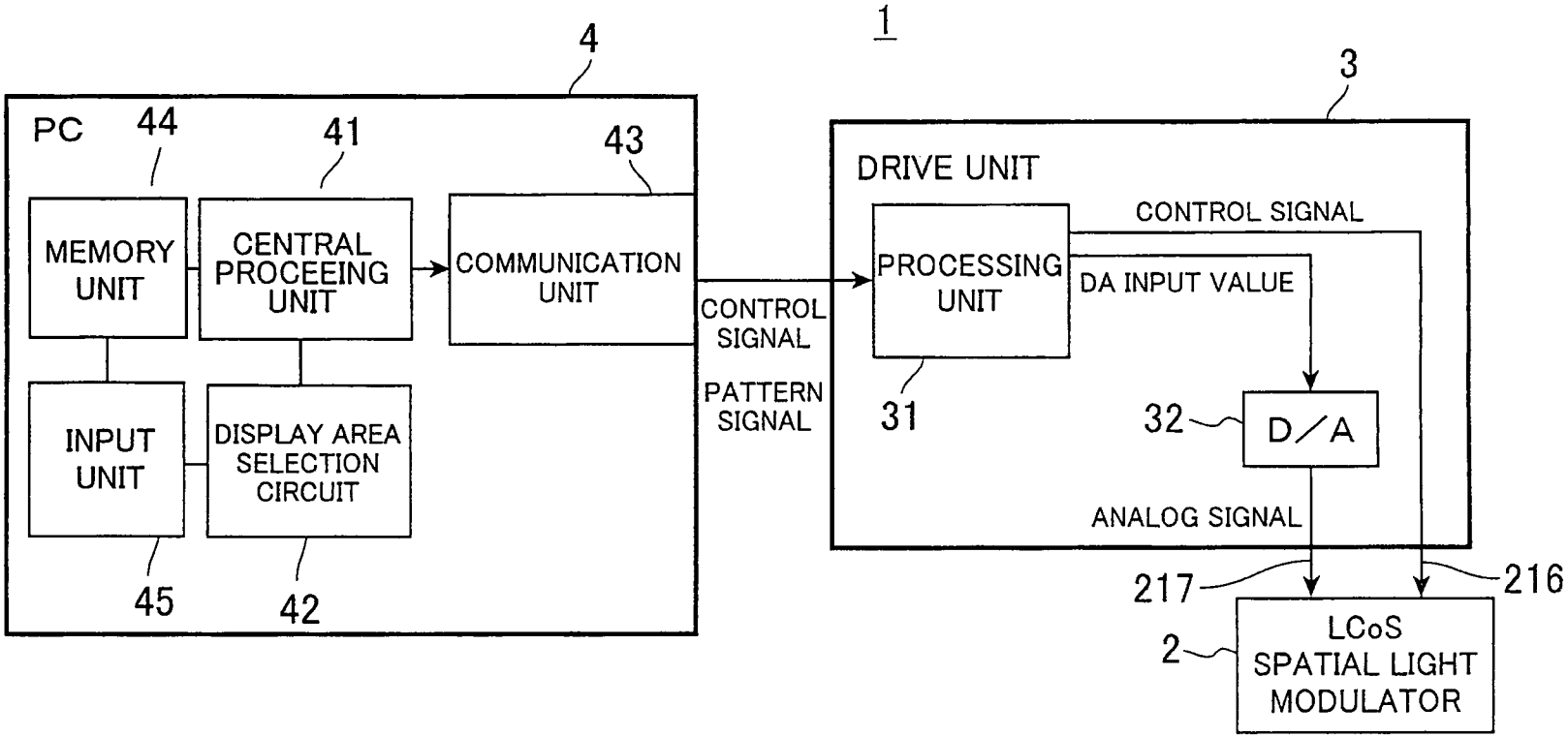
FIG. 1 is a block diagram showing a structure of a phase modulator according to an embodiment.

1 phase modulator
2 LCoS spatial light modulator
3 drive unit
4 control unit
42 display area selection circuit
113, 2113, 3113 circuit substrate
201 drive circuit
202 multiplexer circuit
203, 204 scanning circuit
222-1, 222-201, 223-1, 223-150, 224-1, 224-150, start position selection circuit

BEST MODE FOR CARRYING OUT THE INVENTION

Next, preferred embodiments of the present invention will be described while referring to the accompanying drawings. As shown in FIG. 1, a phase modulator 1 includes an LCoS spatial light modulator 2 according to the preferred embodiment, a drive unit 3 for driving the LCoS spatial light modulator 2 by applying a voltage thereto, and a control unit 4 for transmitting data, such as control input values, to the drive unit 3.

The control unit 4 is a personal computer (PC) and includes an input unit 45, a memory unit 44, a central processing unit 41, a display area selection circuit 42, and a communication unit 43. A desired pattern signal indicating a desired pattern to be displayed on the LCoS spatial light modulator 2 is inputted into the memory unit 44 externally via the input unit 45. The display area selection circuit 42 selects whether the display method is to be a full-screen display or a partial display and specifies display areas when selecting partial display. The display area selection circuit 42 may select the display method and display areas based on data inputted by a user via the input unit 45, the desired pattern signal, or the cross-sectional area of light incident on the LCoS spatial light modulator 2. The central processing unit 41 reads a desired pattern signal from the memory unit 44 and transmits this pattern signal to the drive unit 3 via the communication unit 43. The central processing unit 41 also generates control signals, such as Vsync, Hsync, and display area specification signals based on the display method and display areas specified by the display area selection circuit 42 and transmits these control signals to the drive unit 3 via the communication unit 43.

The drive unit 3 includes a processing unit 31, and a digital/analog (D/A) circuit 32. The processing unit 31 converts the desired pattern signal to a digital/analog (D/A) input value for controlling a drive voltage and regulates the timing at which the D/A input value is inputted into the D/A circuit 32. The D/A circuit 32 converts the D/A input value to an analog signal containing modulation data. The processing unit 31 and the D/A circuit 32 are connected to the LCoS spatial light modulator 2 via a digital signal line 216 and an input line 217, respectively. The drive unit 3 transmits control signals and analog signals including modulation data to the LCoS spatial light modulator 2 via the digital signal line 216 and input line 217, respectively.

Figure 2:
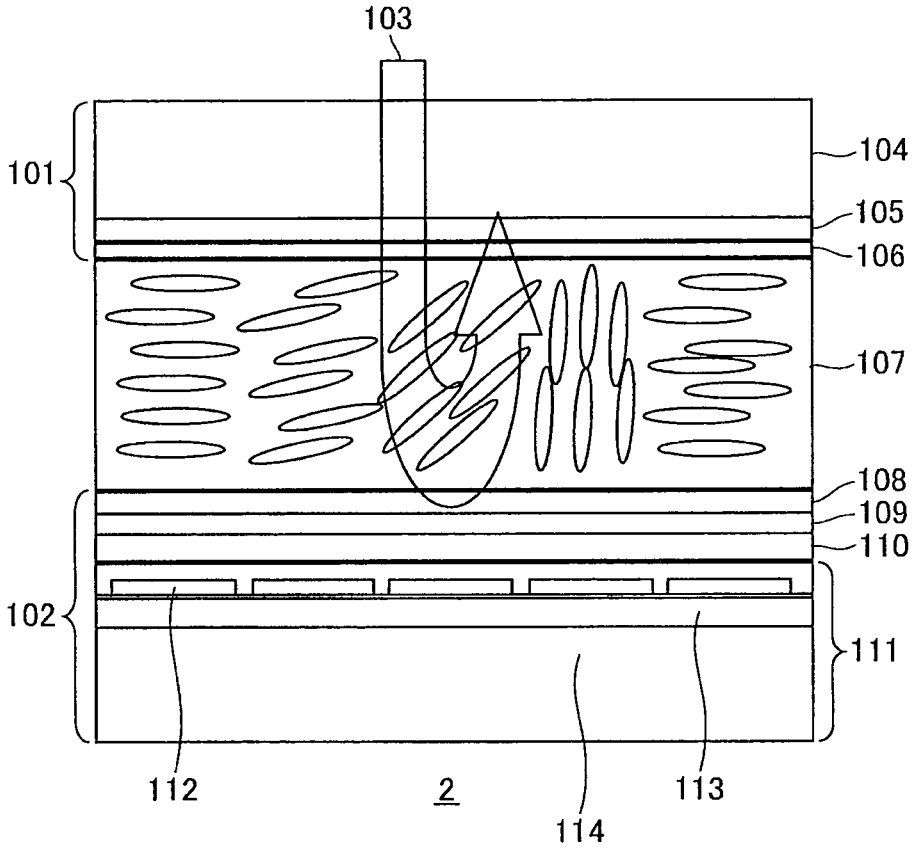
FIG. 2 is a cross-sectional view of the LCoS spatial light modulator.

FIG. 2 is a cross-sectional view of the LCoS spatial light modulator 2. The LCoS spatial light modulator 2 includes an electrically addressable liquid crystal support substrate 102, a transparent liquid crystal support substrate 101, and a liquid crystal layer 107 filling the gap between the liquid crystal support substrates 101 and 102.

The liquid crystal support substrate 101 is configured of a transparent substrate 104, a transparent electrode 105 to which a constant voltage is applied, and an orientation layer 106. The liquid crystal support substrate 102 includes a semiconductor substrate 111, a light-shielding layer 110 for blocking light directed toward the semiconductor substrate 111, a multilayer dielectric mirror 109 for improving the light efficiency, and an orientation layer 108 for aligning the liquid crystal. The semiconductor substrate 111 includes a circuit substrate 113 provided with pixel electrodes 112, and a silicon-based substrate 114. The pixel electrodes 112 also serve as mirrors for reflecting incident light.

The circuit configuration of the circuit substrate 113 will be described in greater detail with reference to FIGS. 3 and 4. The circuit substrate 113 includes a modulation area 206, and a peripheral circuit 214. The peripheral circuit 214 includes a drive circuit 201, a multiplexer circuit 202, and scanning circuits 203 and 204.

Arranged on the modulation area 206 are a plurality (600 in this example) of scan lines 208 (208-1, 208-2, . . . , 208-599, and 208-600) extending in an x-direction and a plurality (800 in this example) of data lines 209 (209-1, 209-2, . . . , 209-799, and 209-800) extending in a y-direction. The scan lines 208 (208-1, 208-2, . . . , 208-599, and 208-600) are connected to the scanning circuits 203 and 204, and the data lines 209 (209-1, 209-2, . . . , 209-799, and 209-800) are connected to the multiplexer circuit 202. One pixel 215 is disposed near the intersection of a single scan line 208 and a single data line 209. Accordingly, a total of 480,000 pixels 215 (FIG. 4) are arranged within the modulation area 206 in a matrix having 800 pixels in each row (x-direction) and 600 pixels in each column (y-direction). For simplification, only some of the scan lines 208 and the data lines 209 are shown in FIG. 3, while the pixels 215 have been omitted. FIG. 4 is an enlarged diagram of a region near the intersection of one scan line 208 and one data line 209. Each pixel 215 is configured of a switch 210, a pixel capacitor 211, and one of the pixel electrodes 112 mentioned earlier, all of the pixels 215 constructing an active matrix circuit over the entire modulation area 206.

The multiplexer circuit 202 selects 20 of the 800 data lines 209 for inputting modulation data. The scanning circuits 203 and 204 select 1 of the 600 scan lines 208 aligned with pixels for which modulation data is to be inputted. The drive circuit 201 receives control signals, such as a Vsync signal, Hsync signal, display area specification signal, and pixel clock signal from the drive unit 3 via the digital signal line 216. The drive circuit 201 transmits drive signals (dclk, dstp, drst) to the multiplexer circuit 202 and control signals (gclk, gstp, grst) to the scanning circuits 203 and 204 based on these control signals. Based on the drive signals, the multiplexer circuit 202 selects 20 data lines 209, and the scanning circuits 203 and 204 select 1 scan line 208 and output a High signal to the selected scan line 208.

The multiplexer circuit 202 is configured of a shift register not shown in the drawing. The shift register is arranged as an array of 40 registers, each register being configured of an array of 20 switches, for a total of 800 switches having a one-on-one correspondence with the 800 data lines 209. When a register is set to High, the multiplexer circuit 202 selects the 20 data lines 209 corresponding to the switches constituting this register. The multiplexer circuit 202 also receives modulation data from the D/A circuit 32 via the input line 217 and outputs this modulation data to the 20 selected data lines 209. The shift register transfers inputted High signals to each register, beginning from the initial register and continuing with subsequent registers in sequence, each time a drive signal (dclk) is received from the drive circuit 201.

Each of the scanning circuits 203 and 204 is configured of a shift register, each shift register being configured of an array of 600 registers. The shift register transfers a High signal inputted into the first register to subsequent registers in sequence each time a drive signal (gclk) is received from the drive circuit 201. The 600 registers have a one-on-one correspondence to the 600 scan lines 208. When a register is set to High, the scanning circuits 203 and 204 select the scan line 208 corresponding to the register set to High.

When modulation data is inputted into the selected data lines 209 and a High signal is simultaneously inputted into the selected scan line 208, the switch 210 of each pixel 215 positioned at intersections of the scan line 208 and the data lines 209 is turned on, applying a voltage to the corresponding pixel electrodes 112.

As illustrated in FIG. 2, a desired potential difference is produced between a pixel electrode 112 and the transparent electrode 105 when a voltage corresponding to the modulation data is applied to the pixel electrode 112, changing the orientation of liquid crystal molecules above the pixel electrode 112 and consequently modulating the phase of incident light 103 on the LCoS spatial light modulator 2. Since the pixel electrodes 112 are arranged in a two-dimensional array, the phase modulation of light caused by differences in voltages applied to the pixel electrodes 112 is distributed two-dimensionally.

Voltages based on modulation data must be inputted into corresponding pixel electrodes 112 to generate a desired modulation pattern. To input modulation data into a pixel electrode 112 at position (x, y), the multiplexer circuit 202 selects the 20 data lines including the data line corresponding to position x, and the scanning circuits 203 and 204 select the scan line at position y. The data lines 209 are selected through chronological shifts in the x-direction, and the scan lines 208 are selected through chronological shifts in the y-direction.

Since application of a DC voltage reduces the life of the liquid crystal, an AC voltage is instead applied to the liquid crystal layer 107, and the sign of the potential difference between the pixel electrode 112 and transparent electrode 105 is reversed every frame. While there are many methods for reversing the sign of the potential difference, such as frame inversion, line inversion, and dot inversion, in either method the sign of the potential difference between the pixel electrode 112 and the transparent electrode 105 is reversed each frame while focusing on a single pixel 215.

Figure 5:
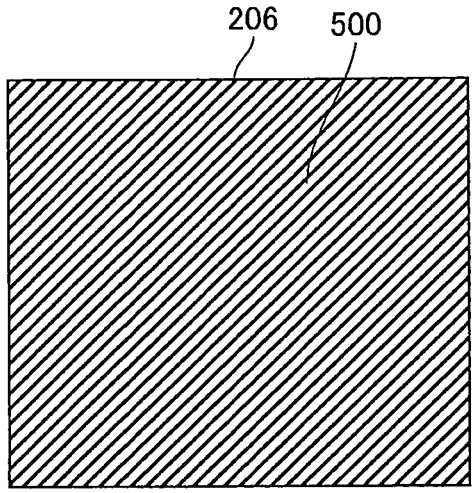
FIG. 5 conceptually illustrates a display region.
Figure 6:
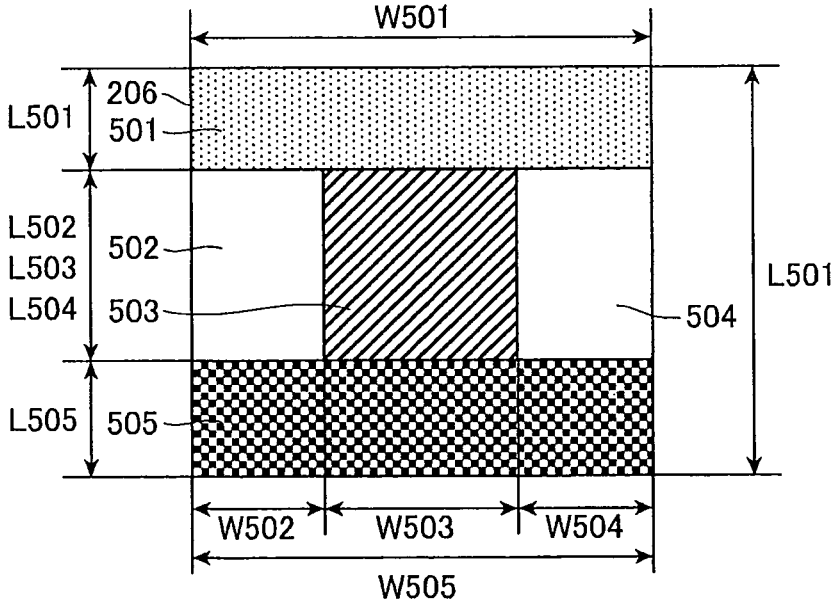
FIG. 6 conceptually illustrates the display region during partial driving.

FIG. 5 conceptually illustrates the display region of the modulation area 206 during full-screen driving. As indicated by shading in FIG. 5, the entire region of the modulation area 206 (800×600 pixels) forms a display area 500 in a full-screen display. FIG. 6 conceptually illustrates the display region of the modulation area 206 during partial driving. Here, the modulation area 206 is divided into a display area 503 positioned in the center, and non-display areas 501, 502, 504, and 505.

The display area selection circuit 42 of the control unit 4 can select either the display area 500, or the display area 503 for partial driving. In the preferred embodiment, the non-display area 501 positioned in the top section of the modulation area 206 has a length L501 of 44 pixels and a width W501 of 800 pixels. The non-display area 502, the display area 503, and the non-display area 504 are arranged from left-to-right beneath the non-display area 501. The non-display areas 502 and 504 have respective widths W502 and W504, each being 144 pixels, and respective lengths L502 and L504, each being 512 pixels. A width W503 and length L503 of the display area 503 are both 512 pixels. The non-display area 505 has a length L505 of 44 pixels and a width W505 of 800 pixels. A display start signal is generated to indicate a position shifted W502 in the x-direction and shifted L501 in the y-direction from the upper left corner of the modulation area 206 as the display start position, and to indicate the display size (W503, L503).

Figure 7A:
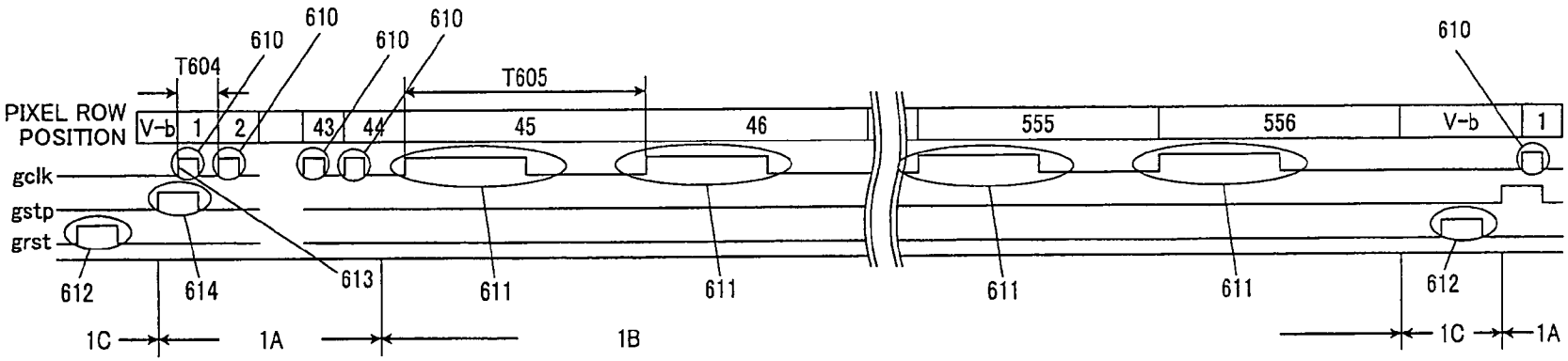
FIG. 7(A) is a timing chart for shifts with respect to rows in the partial driving according to the embodiment.

Next, a method of writing modulation data according to the preferred embodiment will be described with reference to the timing charts in FIGS. 7(A) and 7(B). As shown in FIG. 7(A), the drive circuit 201 inputs drive signals (gclk, gstp, grst) into the scanning circuits 203 and 204 based on a display area specification signal specifying the display area 503, a Vsync signal, an Hsync signal, and a pixel clock signal for each frame during partial display. Here, one frame can be divided into the following time segments.

[Segment 1A] Select 44 rows from the $1^{st}$ row to the $44^{th}$ row (non-display area 501)

[Segment 1B] Select 512 rows from the $45^{th}$ row to the $556^{th}$ row (non-display area 502, display area 503, and non-display area 504)

[Segment 1C] Select 44 rows from the $557^{th}$ row to the $600^{th}$ row (non-display area 505)

Figure 7B:
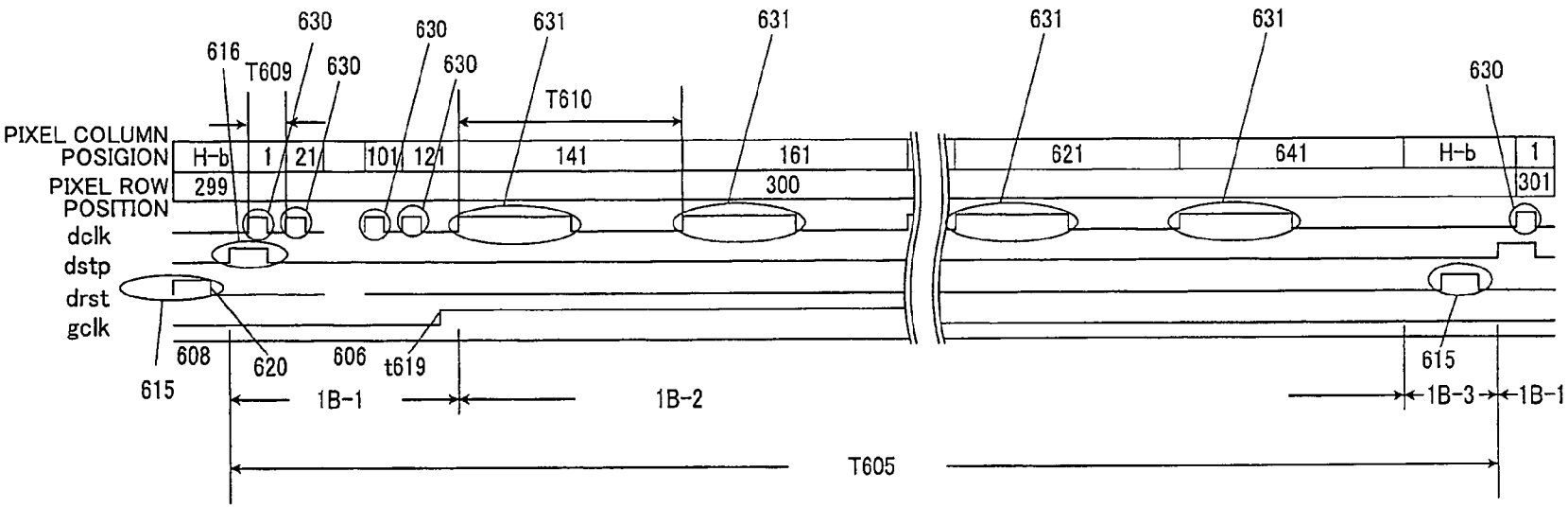
FIG. 7(B) is a timing chart for shifts with respect to columns in the partial driving according to the embodiment.

As shown in FIG. 7(B), in segment 1B, the drive circuit 201 inputs drive signals (dclk, dstp, drst) into the multiplexer circuit 202. FIG. 7(B) also indicates the signal gclk from FIG. 7(A). The following three time segments are repeated 512 times (512 rows worth) in segment 1B.

[Segment 1B-1] Select 140 columns from the $1^{st}$ column to the $140^{th}$ column (non-display area 502)

[Segment 1B-2] Select 520 columns from the $141^{st}$ column to the $660^{th}$ column (display area 503)

[Segment 1B-3] Select 140 columns from the $661^{st}$ column to the $800^{th}$ column (non-display area 504)

The timing for inputting drive signals gclk, gstp, and grst related to the y-direction will be described with reference to FIG. 7(A). In the following description, gclk and dclk pulses will be respectively referred to as the row shift signal and the column shift signal, while the grst and drst pulses will be respectively referred to as the frame reset signal and the column reset signal. First, the grst signal rises as a frame reset signal 612, resetting all registers in the scanning circuits 203 and 204. Hence, the scanning circuits 203 and 204 are selecting no scan lines at this time. Next, a pulse 614 rises in the gstp signal, indicating the start timing for segment 1A. While the pulse 614 remains High, the gclk signal rises as a row shift signal 610 at a timing 613, setting the first register in the scanning circuits 203 and 204 to High. Accordingly, the scanning circuits 203 and 204 now select the scan line 208-1 of the first row. The period of the gclk pulse during segment 1A is T604. The pulse width of gstp (length of time that the pulse 614 remains High) is regulated so that gclk rises only once while gstp is High. Thereafter, the selected scan line 208 is sequentially shifted one row in the y-direction each time the row shift signal 610 rises. The row shift signal 610 is transmitted 44 times during segment 1A. During segment 1A, all drive signals drst, dstp, and dclk related to shifts in the x-direction are set to Low to prevent the multiplexer circuit 202 from inputting external modulation data.

As shown in FIG. 7(A), a row shift signal 611 is transmitted 512 times in segment 1B. The selected scan line 208 is sequentially shifted one row at a time in the y-direction each time the row shift signal 611 rises. The start timing of segment 1B occurs prior to the rise of the first row shift signal 611. Since data is inputted into pixels during segment 1B, a period T605 of the row shift signals 611 is longer than the period T604. Positions in the x-direction are selected in segments 1B-1, 1B-2, and 1B-3. The frame reset signal 612 rises in segment 1C to reset the registers of the scanning circuits 203 and 204. The length of interval 1C is equivalent to the vertical blanking interval (V-b). Subsequently, control is performed for the next frame, thereby sequentially displaying frames by repeatedly performing segments 1A through 1C.

Next, the method of selecting positions in the x-direction will be described with reference to FIG. 7(B). The length of time required for segments 1B-1 through 1B-3 is equivalent to the period T605. First, the drst signal rises as a column reset signal 615 during the horizontal blanking interval (H-b), resetting all registers in the multiplexer circuit 202. Consequently, the multiplexer circuit 202 is not selecting any data lines 209 at this time. While a pulse 616 of the dstp is High in segment 1B-1, the dclk signal rises once as a column shift signal 630, whereby the multiplexer circuit 202 selects 20 columns from the first column to the $20^{th}$ column. The rising start timing of the dstp pulse 616 denotes the start time of segment 1B-1. Therefore, the rising start timing of the dstp pulse 616 that rises in the $44^{th}$ pixel row position is the start time of segment 1B. In segment 1B-1, the position of the data lines 209 selected by the multiplexer circuit 202 is shifted rightward 20 pixels each time the column shift signal 630 rises. The multiplexer circuit 202 selects 20 data lines 209 at one time. For example, the multiplexer circuit 202 selects data lines 209-1 through 209-20 the first time the column shift signal 630 rises, and selects data lines 209-21 through 209-40 at the next column shift signal 630. After the multiplexer circuit 202 selects data lines 209-121 through 209-140 when the $7^{th}$ column shift signal 630 rises, the timing chart transitions to segment 1B-2. A column shift signal 631 rises in segment 1B-2. Since pixels are specified collectively for 20 columns, the pixel column position in FIG. 7(B) indicates the pixel in the $1^{st}$ (leftmost) of the 20 specified columns. After the $7^{th}$ column shift signal 630 in FIG. 7(B), the row shift signal 611 (gclk) rises at a time t619 just before the $1^{St}$ column shift signal 631 rises. However, the rise timing of the row shift signal 611 may be set arbitrarily within segment 1B-1. It is also necessary to set the voltage value inputted onto the data lines to a value small enough not to cause modulation during segment 1B-1. The rise in gclk corresponds to the rise in the row shift signal 611 in segment 1B of FIG. 7(A).

The $1^{st}$ column shift signal 631 in segment 1B-2 shifts the write position 20 pixels in the x-direction so that the multiplexer circuit 202 selects pixels 141-160, and simultaneously writes modulation data to the pixel electrode 112. The write position is sequentially shifted by 20 pixels each time the column shift signal 631 rises with modulation data being written to pixels 641-660 at the $26^{th}$ column shift signal 631. Since data is inputted into pixels within a period T610 of the column shift signal 631 in segment 1B-2, the period T610 is set at least as long as the charge accumulation time. However, since data need not be inputted into pixels in segment 1B-1, the period T609 of the column shift signal 630 is set shorter than the period T610. Further, since the pixels in columns 145-656 define the display area, the initial pixels 141-144 and the last pixels 657-660 in segment 1B-2 belong to the non-display areas 502 and 504. Accordingly, voltage values that do not produce modulation may be inputted into these pixels, or the pixels may be modulated and displayed as dummy pixels.

The column reset signal 615 (drst) rises in segment 1B-3 because there is no need to input modulation data, nor a need to input a shift signal first. As a result, the selection of data lines 209 is reset. The length of segment 1B-3 (the time interval from the end of the charge accumulation time (T610) for the shift end pixel column (641) to the start of the shift for the shift start pixel column (1)) is equivalent to the horizontal blanking interval (H-b). Thereafter, control proceeds to the selection of columns in the next row and segments 1B-1 through 1B-3 are repeatedly performed, thus displaying pixels in rows 45 through 556. While FIG. 7(B) shows the state of drive signals (dclk, dstp, drst, and gclk) for the 300$^{th}$ row, these signals are the same in rows 45 through 556.

Here, the frame rates will be compared for the full-screen display and the partial display according to the preferred embodiment. The following equation assumes that modulation data is inputted for 20 pixels simultaneously, where the charge accumulation time for each pixel is 80 ns, the horizontal blanking interval is 0.3 μs, and the vertical blanking interval is 300 μs. A frame rate becomes 420 frames per second (Hz) for a full-screen display (800×600 pixels) from the following equations:

1 frame time=(charge accumulation time×pixel column size/parallel input number+horizontal blanking interval)×pixel row size+vertical blanking interval (Equation 1)

Frame rate=1/(1 frame time) (Equation 2)

On the other hand, a frame rate becomes 630 frames per second (Hz) as follows when performing partial driving of 512×512 pixels according to the method described above.

First, the period T604 of the row shift signal 610 in segment 1A can be set smaller than the charge accumulation time of 80 ns. In the preferred embodiment, the period T604 is set to 20 ns. Hence, the time required for segment 1A is 20 ns×44 rows=0.88 μs.

Although modulation data is inputted into data lines 209 for 144 columns in segment 1B-1, the columns are shifted 7 times while inputting modulation data for 20 columns simultaneously. Further, the period T609 of the column shift signal 630 can be set to the minimum 20 ns. Consequently, the time required for segment 1B-1 is 20 ns×7 times=140 ns.

Although 512 columns are driven in segment 1B-2 during partial driving, the length of segment 1B-2 must be sufficient for inputting data for 520 columns, since modulation data is inputted in parallel for 20 columns at a time. Since modulation data is actually inputted for only 512 pixels in the 520 columns, the remaining 8 pixels are displayed as dummy pixels or receive an input voltage not sufficient for causing modulation. In either case, the columns must be shifted 26 times. Further, since the period T610 of the column shift signal 631 is equivalent to the charge accumulation time of 80 ns, the time required for segment 1B-2 is 80 ns×26 times=2.08 μs. The length of the reset signal serving as the horizontal blanking interval in segment 1B-3 is 0.3 μs. The length of the reset signal serving as the vertical blanking interval in segment 1C is 300 μs.

The time of one frame is equivalent to (time of segment 1A)+(time of segment 1B-1+time of segment 1B-2+time of segment 1B-3)×512+(time of segment 1C)=1,590 μs, and the frame rate is 630 Hz.

Since it is not necessary to input modulation data for pixels in segment 1A, the period T604 of the row shift signal 610 can be set shorter than the period T605 of the row shift signal 611 in segment 1B. Further, since it is not necessary to input modulation data for pixels in segment 1B-1, the period T609 of the column shift signal 630 can be set shorter than the period T610 of the column shift signal 631.

Since it is not necessary to input modulation data or to input a shift signal first in segment 1C, the control process may return immediately to segment 1A to begin writing the next frame. Segment 1C need only be long enough to reset the scanning circuits 203 and 204 (length of the pulse 612) and, hence, is set equivalent to the vertical blanking interval.

By performing partial driving in the preferred embodiment, the frame rate is increased from 420 to 630 Hz, thereby reducing modulation fluctuations while achieving high image quality. Further, since it is not necessary to input modulation data for non-display regions, the row shift signals 610 and the column shift signals 630 can be made shorter than when inputting such modulation data, achieving a higher frame rate without adding a special circuit. Further, partial driving can be performed at arbitrary positions by appropriately changing the number of row shift signals 610 and column shift signals 630 having shorter periods.

(First Variation)

Figure 3:
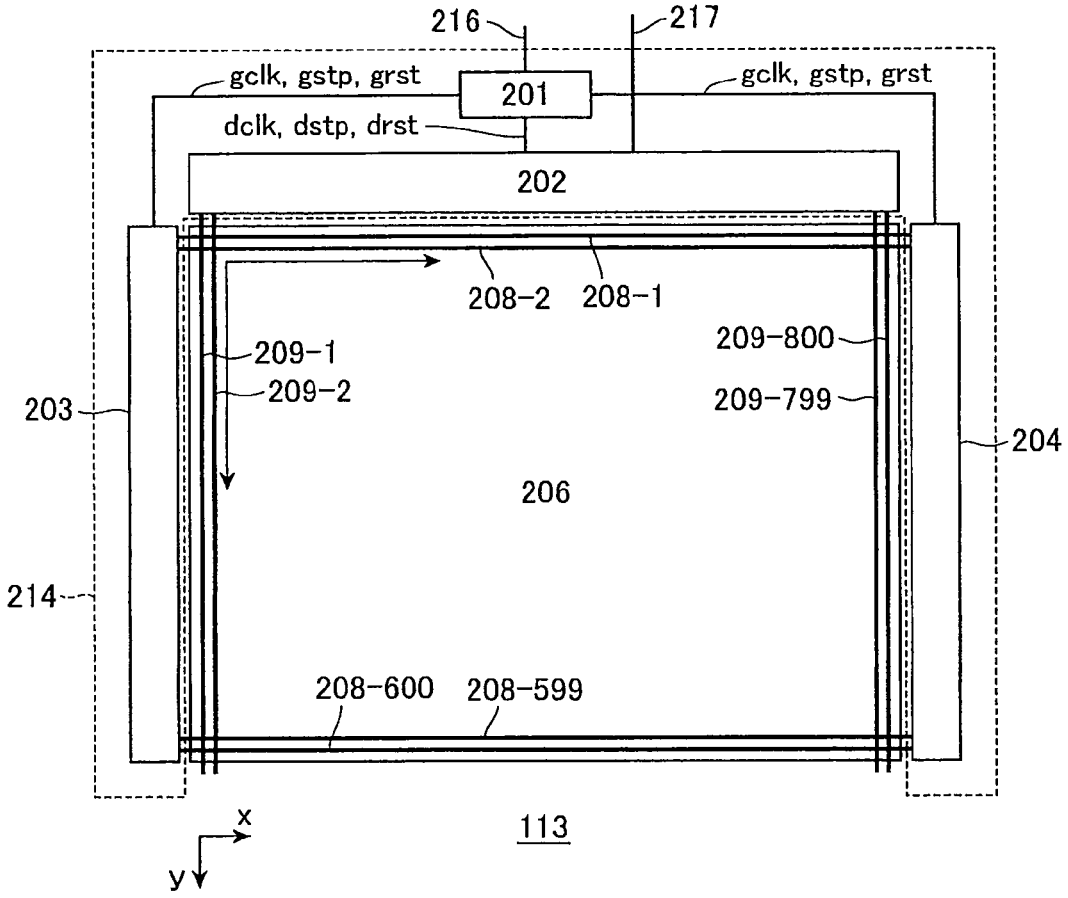
FIG. 3 is a view showing a circuit substrate of the LCoS spatial light modulator.
Figure 4:
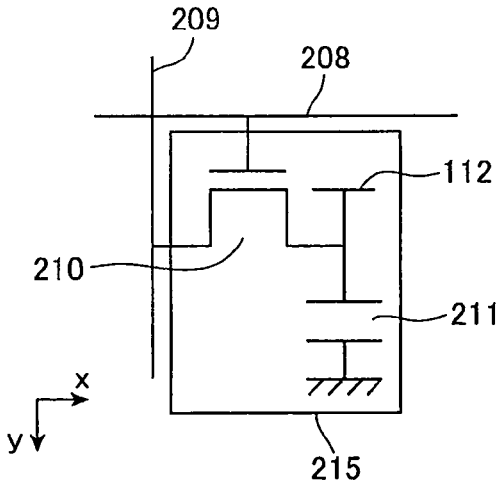
FIG. 4 is a view showing a structure of circuit of pixel.
Figure 8:
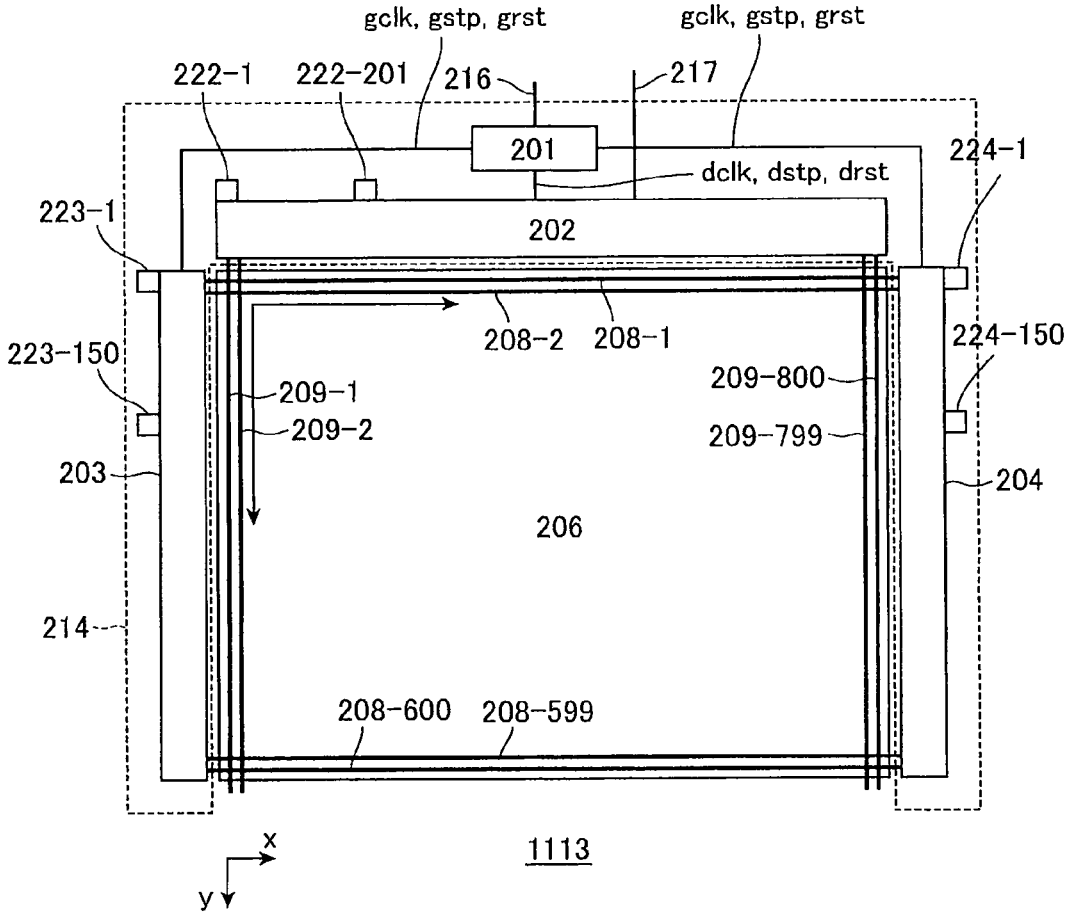
FIG. 8 is a view showing a circuit substrate according to a first variation.

In a variation of the LCoS spatial light modulator 2, the circuit substrate 113 shown in FIG. 3 is replaced with a circuit substrate 1113 shown in FIG. 8. In the circuit substrate 1113, the multiplexer circuit 202 is provided with start position selection circuits 222-1 and 222-201. In addition, the scanning circuit 203 is provided with start position selection circuits 223-1 and 223-150, and the scanning circuit 204 is provided with start position selection circuits 224-1 and 224-150. The remaining structure of the circuit substrate 1113 is identical to the circuit substrate 113 and will not be described herein.

The start position selection circuits 223-1 and 224-1 function to direct the respective scanning circuits 203 and 204 in selecting the 1$^{st}$ register, and the start position selection circuits 223-150 and 224-150 function to direct the corresponding scanning circuits 203 and 204 in selecting the 150$^{th}$ register. When the drive circuit 201 specifies either the start position selection circuits 223-1 and 224-1 or the start position selection circuits 223-150 and 224-150, the scanning circuits 203 and 204 select either the corresponding 1$^{st}$ or 150$^{th}$ register, thereby selecting either the corresponding scan line 208-1 or 208-150. Thereafter, the selected scan line is sequentially shifted one row in the y-direction each time the gclk signal rises. Similarly, when the drive circuit 201 specifies one of the start position selection circuits 222-1 and 222-201, the multiplexer circuit 202 selects the corresponding 1$^{st}$ or 11$^{th}$ register, thereby selecting either data lines 209-1 through 209-20 or data lines 209-201 through 209-220 corresponding to the register. Thereafter, the selected data lines are sequentially shifted 20 columns in the x-direction each time the dclk signal rises.

Next, an example of partial driving with the start position selection circuits 223-1, 223-150, 224-1, 224-150, 222-1, and 222-201 will be described with reference to FIGS. 9(A) and 9(B). In this example, partial driving will be performed for a region 320×240 pixels in the modulation area 206 having 800×600 pixels. With respect to FIG. 6, the display area 503 in this example has a width W503 of 320 pixels and a length L503 of 240 pixels; the non-display areas 501 and 505 above and below the display area 503 have lengths L501 and L505 both of 180 pixels; and the non-display areas 502 and 504 positioned on the left and right of the display area 503 have widths W502 and W504 both of 240 pixels.

One frame is divided into the following three segments.

[Segment 2A] 149 rows from the 1$^{st}$ row to the 149$^{th}$ row (portion of the non-display area 501 prior to selection by the start position selection circuits 223-150 and 224-150), and 31 rows from the 150$^{th}$ row to the 180$^{th}$ row (portion of the non-display area 501 after selection by the start position selection circuits 223-150 and 224-150)

[Segment 2B] 240 rows from the 181$^{st}$ row to the 420$^{th}$ row (non-display area 502, display area 503, and non-display area 504)

[Segment 2C] 180 rows from the 421$^{st}$ row to the 600$^{th}$ row (non-display area 505)

In segment 2B, the following three time segments 2B-1, 2B-2, and 2B-3 related to column selection are repeated 240 times.

[Segment 2B-1] 200 columns from the 1st column to the 200th column (the portion of the non-display area 502 prior to selection by the start position selection circuit 222-201), and 40 columns from the 201st column to the 240th column (the portion of the non-display area 502 after selection by the start position selection circuit 222-201)

[Segment 2B-2] 320 columns from the 241st column to the 560th column (display area 503)

[Segment 2B-3] 240 columns from the 561st column to the 800th column (non-display area 504)

Segments 2B-2, 2B-3, and 2C correspond to segments 1B-2, 1B-3, and 1C of the preferred embodiment and are identical except for the number of rows and columns.

Figure 9A:
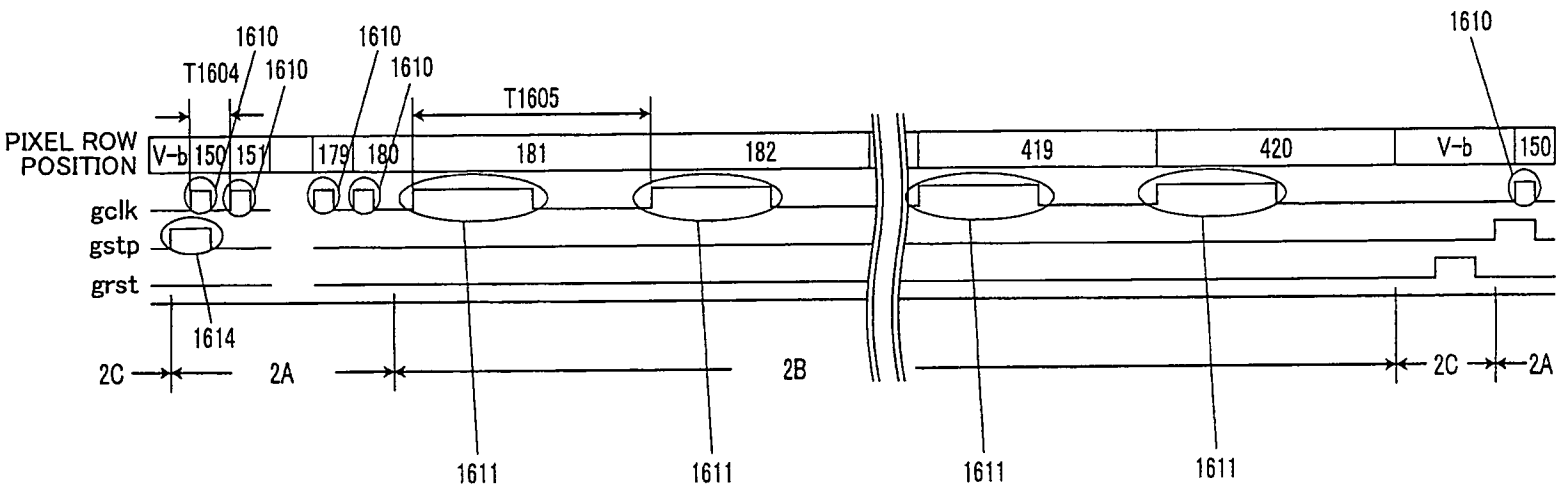
FIG. 9(A) is a timing chart for shifts with respect to rows direction in the partial driving according to the first variation.

As shown in FIG. 9(A), a pulse 1614 first rises in the gstp signal in segment 2A. Further, the drive circuit 201 transmits drive signals to the scanning circuits 203 and 204 specifying the start position selection circuits 223-150 and 224-150, respectively. While the pulse 1614 remains High, the gclk signal rises as a row shift signal 1610, by which the start position selection circuits 223-150 and 224-150 set the 150th register in the scanning circuits 203 and 204 to High. Accordingly, the scanning circuits 203 and 204 now select the scan line 208-150. Thereafter, the selected scan line 208 is sequentially shifted one row in the y-direction each time the row shift signal 1610 rises. The row shift signal 1610 is transmitted 31 times during segment 2A. In other words, the row position is shifted each time the row shift signal 1610 rises, and the process transitions to segment 2B after the 181st row has been selected. The period of the row shift signal 1610 is T1604. In segment 2B, the selected scan line 208 continues to be shifted sequentially one row in the y-direction each time a row shift signal 1611 rises. The row shift signal 1611 is transmitted 240 times in segment 2B. The period of the row shift signal 1611 in segment 2*b* is T1605. The period T1604 is smaller than the period T1605. In segment 2C, the grst signal rises as a reset signal, whereby the scanning circuits 203 and 204 no longer select a scan line 208, and subsequently the process advances to the next frame.

Figure 9B:
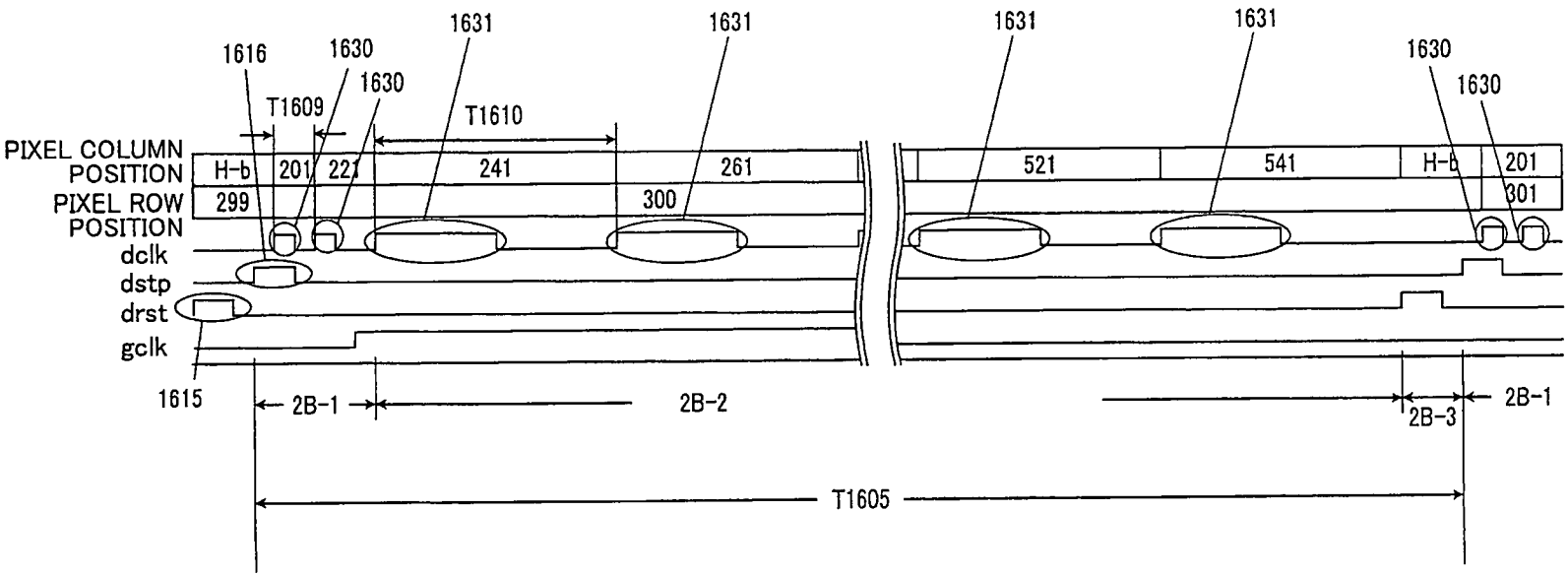
FIG. 9(B) is a timing chart fors shift with respect to columns in the partial driving according to the first variation.

As shown in FIG. 9(B), the drst signal rises as a reset signal 1615, resetting the multiplexer circuit 202 so that the multiplexer circuit 202 is no longer selecting data lines 209. Next, in segment 2B-1, the drive circuit 201 transmits a pulse 1616 in the dstp signal to the multiplexer circuit 202 and transmits a drive signal to the multiplexer circuit 202 specifying the start position selection circuit 222-201. While the pulse 1616 is High, the dclk signal rises as a column shift signal 1630, whereby the start position selection circuit 222-201 sets the 11th register of the multiplexer circuit 202 to High. Consequently, the multiplexer circuit 202 has now selected data lines 209-201 through 209-220. The column shift signal 1630 rises twice in segment 2B-1 before the process advances to segment 2B-2. In segment 2B-2, a column shift signal 1631 rises sixteen times. The column shift signal 1630 in segment 2B-1 has a period T1609 that is shorter than the period T1610 of the column shift signal 1631 in segment 2B-2.

As described below, the frame rate for partial driving of 320×240 pixels according to this variation is 1540 frames per second (Hz), where, as in the preferred embodiment, the charge accumulation time is 80 ns, the horizontal blanking interval is 0.3 μs, and the vertical blanking interval is 300 μs.

When the period T1604 of the row shift signal 1610 is set to the minimum 20 ns, as in the first embodiment, the time required for segment 2A is 20 ns×31 rows=0.62 μs, since the scan line need only be shifted 31 rows from the 150th row to the 180th row. The time required for segment 2C is 300 μs, equivalent to the vertical blanking interval.

Although shifts in the x-direction cover 40 columns from the 201st column to the 241st column in segment 2B-1, by inputting modulation data in parallel for 20 columns at a time, the column shift signal 1630 is only transmitted twice. Further, the period T1609 of the column shift signal 1630 is the minimum 20 ns. Consequently, the required time for segment 2B-1 is 2×20 ns=40 ns.

Since modulation data is inputted in parallel for 20 columns at a time in segment 2B-2, the column position is shifted 16 times for 320 columns. By setting the period T1610 of the column shift signal 1631 to account for charge accumulation time, the required time for segment 2B-2 is 16×80 ns=1.28 μs. The time required for segment 2B-3 is 0.3 μs, which is equivalent to the horizontal blanking interval.

The time of one frame is equivalent to (time of segment 2A)+(time of segment 2B-1+time of segment 2B-2+time of segment 2B-3)×240=680 μs, and the frame rate is 1470 Hz. Hence, performing partial driving with the start position selection circuits 223-150, 224-150, and 222-201 increases the frame rate from 420 Hz in a full-screen display to 1470 Hz.

According to this variation of the embodiment, the frame rate in partial driving can be further improved using only a small number of the start position selection circuits 221-1, 222-201, 223-1, 223-150, 224-1, and 224-150. Accordingly, high image quality is achieved.

It is also possible to perform partial driving with the start position selection circuits if the start position in the display area is downward and rightward of the position indicated by the start position selection circuits, resulting in a shorter shift time in non-display regions than that in the preferred embodiment described above. Accordingly, this variation can further improve the frame rate from that in partial driving according to the preferred embodiment, while achieving high image quality.

(Second Variation)

Figure 10:
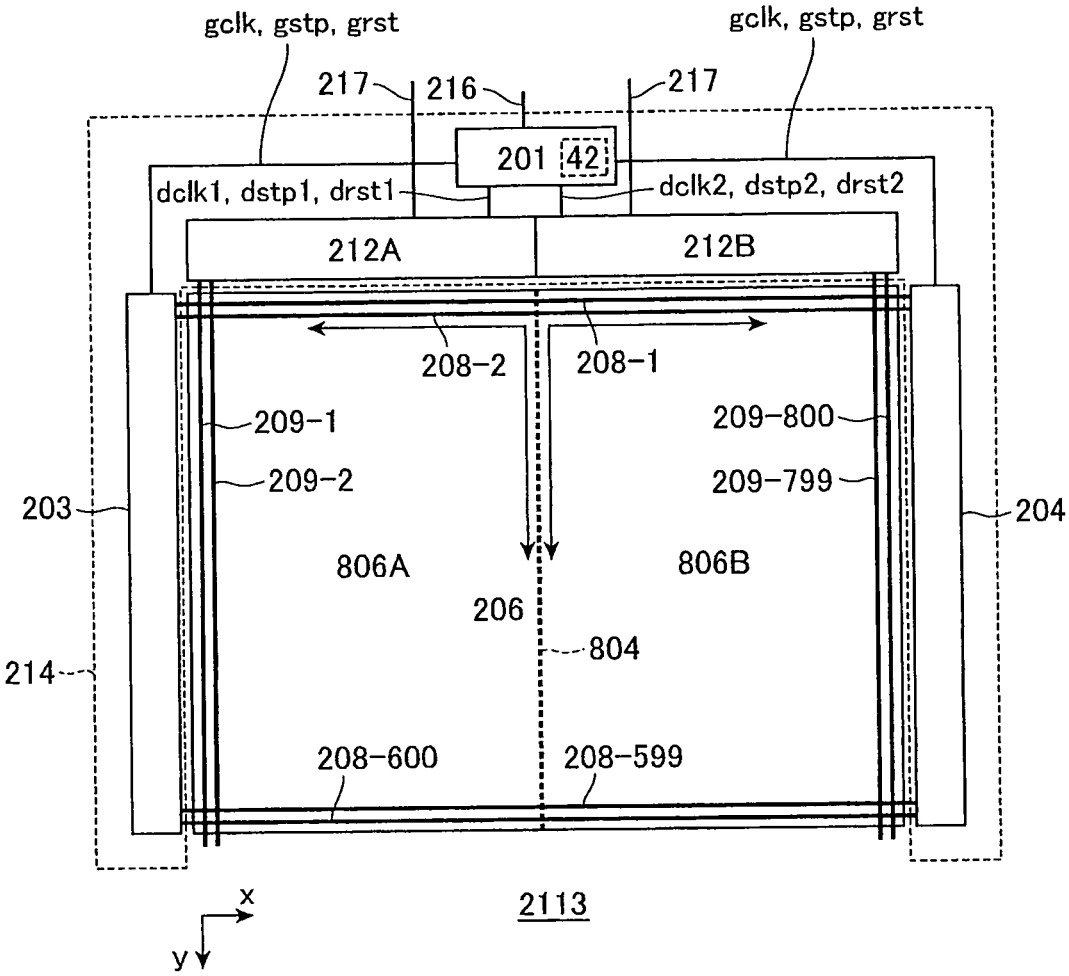
FIG. 10 is a view showing a circuit substrate according to a second variation.

A circuit substrate 2113 shown in FIG. 10 may be used in place of the circuit substrate 113. The circuit substrate 2113 drives divisions of the modulation area 206. That is, the modulation area 206 is divided into a first modulation area 806A and a second modulation area 806B. The circuit substrate 2113 is provided with multiplexer circuits 212A and 212B for each modulation area, and is provided with two of the input lines 217 respectively connected to the multiplexer circuits 212A and 212B. The multiplexer circuit 212A is connected to 400 data lines 209-1, . . . , 209-400, while the multiplexer circuit 212B is connected to the remaining 400 data lines 209-401, . . . , 209-800. The border between the first and second modulation areas 806A and 806B is virtually depicted by a borderline 804 interposed between data lines 209-400 and 209-401. The display area selection circuit 42 of the control unit 4 always selects a display area that includes at least part of the borderline 804. Hence, the display area selection circuit 42 selects a region including at least part of the data line 209-400 and at least part of the data line 209-401.

The drive circuit 201 transmits drive signals gclk1, dstp1, and drst1 to the multiplexer circuit 212A and transmits drive signals gclk2, dstp2, and drst2 to the multiplexer circuit 212B. The multiplexer circuit 212A shifts the selected data lines 209 ten at a time toward the left from data line 209-400 to data line 209-1, while the multiplexer circuit 212B shifts the selected data lines 209 ten at a time toward the right from data line 209-401 to data line 209-800. Therefore, in the first modulation area 806A, modulation data is sequentially inputted from the data line 209-400 just left of the borderline 804 toward the data line 209-1 on the left edge. In the second modulation area 806B, modulation data is sequentially inputted from the data line 209-401 just right of the borderline 804 toward the data line 209-800 on the right edge. Modulation data is inputted in parallel for ten columns in each of the first and second modulation areas 806A and 806B, thereby simultaneously inputting modulation data for a total of twenty columns. This variation eliminates the need for the short-period scanning in non-display regions described above and for start position selection circuits during partial driving.

Figure 11:
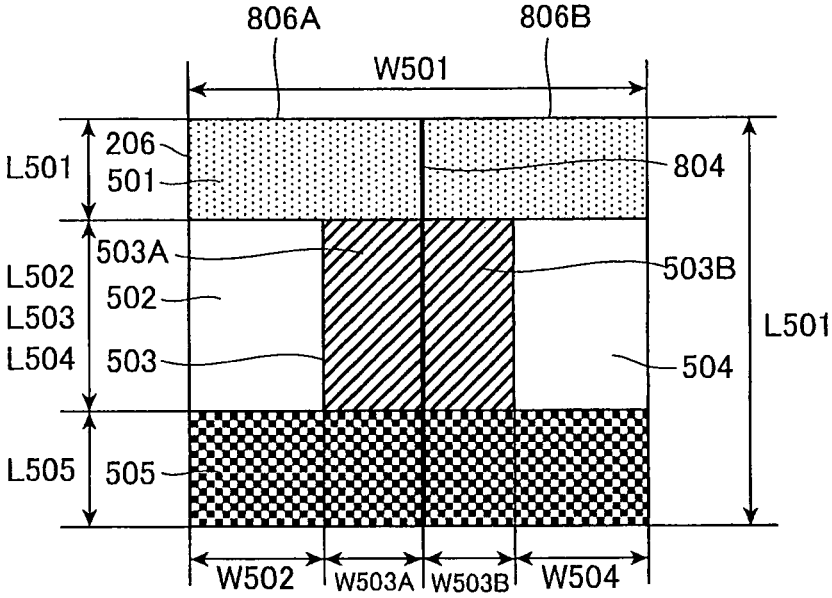
FIG. 11 conceptually illustrates divided display areas.

Examples of partial driving according to this variation of the embodiment will be given for both a symmetric display in which display areas are symmetric about the borderline 804, and an asymmetric display in which the display areas are asymmetric about the borderline 804. In the symmetric display, the central processing unit 41 performs partial driving after selecting a display area 503 including the borderline 804. FIG. 11 conceptually illustrates display areas when the modulation area 206 is divided into the first and second modulation areas 806A and 806B. The display area 503 is divided by the borderline 804 into a first display area 503A and a second display area 503B. The positional relationship among the non-display areas 501, 502, 504, and 505 and the display area 503 is identical to the example shown in FIG. 6. As in the preferred embodiment described above, the display area 503 has 512×512 pixels, while the non-display areas 501, 502, 504, and 505 are identical to the description in the preferred embodiment. The first display area 503A is composed of 256×512 pixels between columns 145 and 400 and rows 45 and 556. The second display area 503B is composed of 256×512 pixels between columns 401 and 656 and rows 45 and 556. Accordingly, the first and second display areas 503A and 503B have respective widths W503A and W503B both of 256 pixels. In the following description, the gclk pulse will be referred to as a row shift signal, the dclk1 and dclk2 pulses as column shift signals, the grst pulse as a frame reset signal, and the drst1 and drst2 pulses as column reset signals.

Figure 12A:
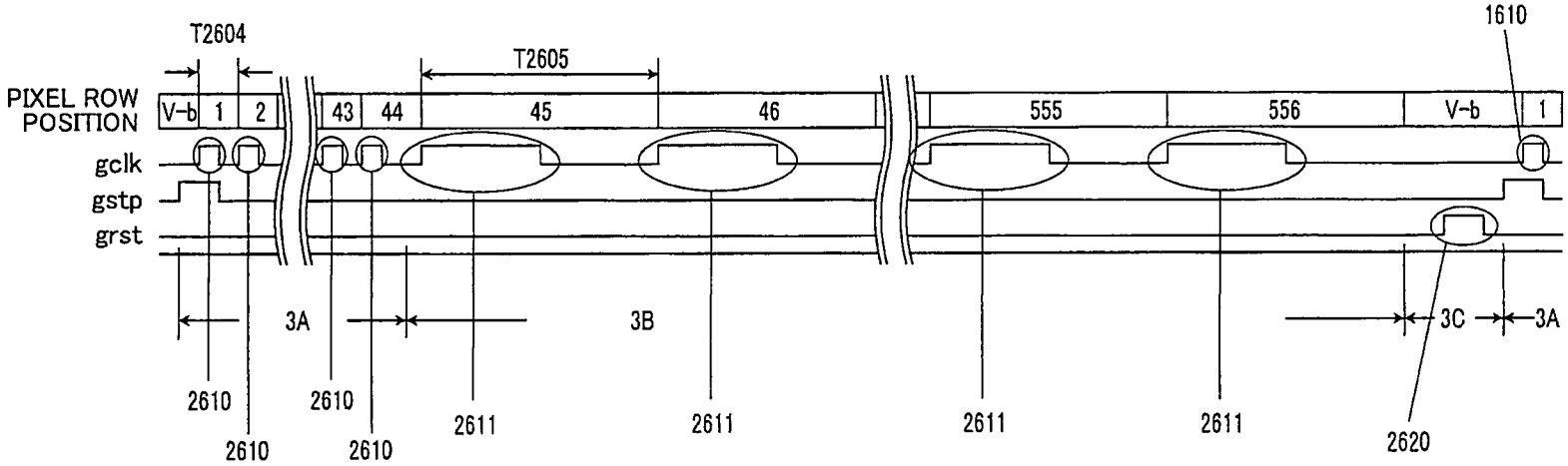
FIG. 12(A) is a timing chart for shifts with respect to rows in a symmetric display according to the second variation.

As shown in FIG. 12(A), one frame is divided into the following three time segments.

[Segment 3A] 44 rows from the $1^{st}$ row to the $44^{th}$ row (non-display area 501)

[Segment 3B] 512 rows from the $45^{th}$ row to the $556^{th}$ row (non-display area 502, display area 503, and non-display area 504)

[Segment 3C] 44 rows from the $557^{th}$ row to the $600^{th}$ row (non-display area 505)

Figure 12B:
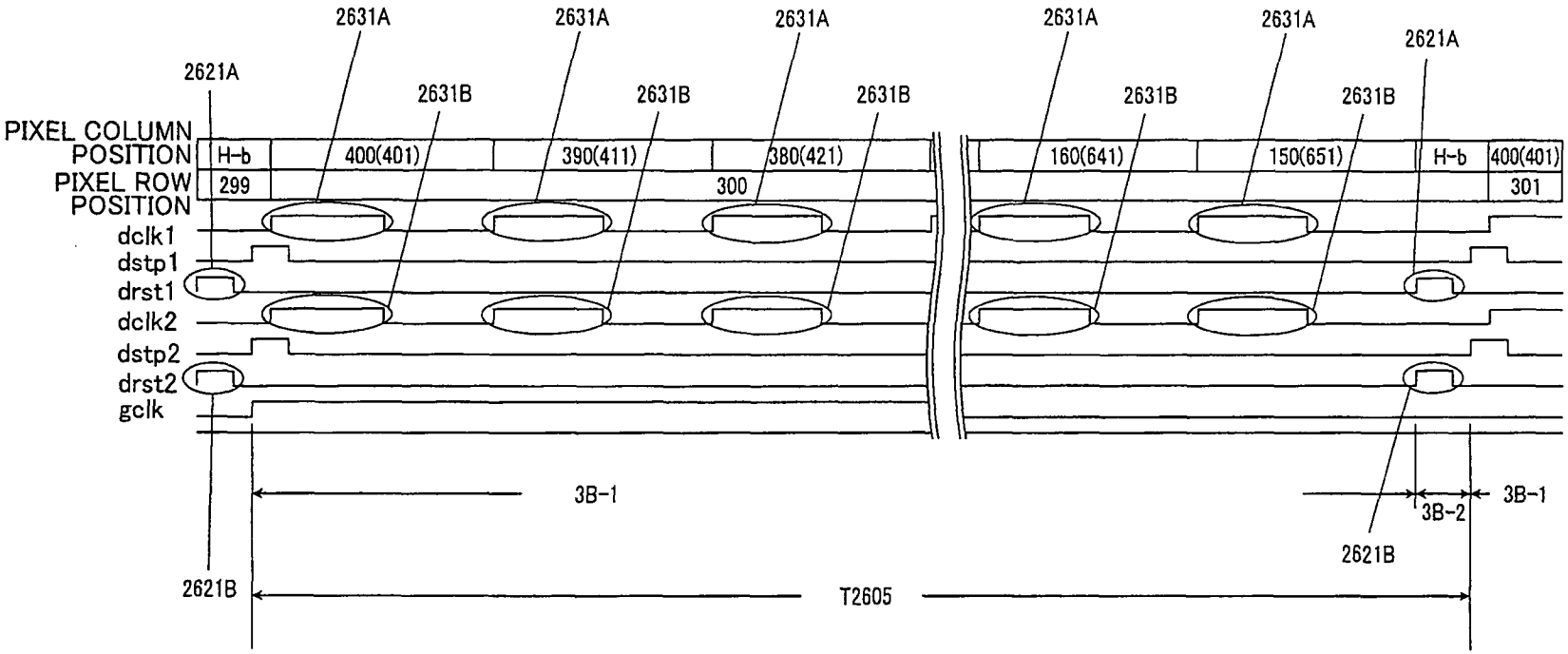
FIG. 12(B) is a timing chart for shifts with respect to columns in the symmetric display according to the second variation.

Further, as shown in FIG. 12(B), the following two time segments are repeated 512 times in segment 3B.

[Segment 3B-1] 260 columns from the $400^{th}$ column to the $141^{st}$ column and 260 columns from the $401^{st}$ column to the $660^{th}$ column for a total of 520 columns (display area 503)

[Segment 3B-2] 140 columns from the $1^{st}$ column to the $140^{th}$ column and 140 columns from the $661^{st}$ column to the $800^{th}$ column (non-display areas 502 and 504)

FIG. 12(A) is a timing chart for shifts in the y-direction. As in FIG. 7(A) described in the preferred embodiment, the selected scan line 208 is shifted one row at a time in the y-direction from the $1^{st}$ row to the $44^{th}$ row each time the gclk rises as a row shift signal 2610 (period T2604) in segment 3A. The 2610 is transmitted 44 times in segment 3A. The gclk signal rises as a row shift signal 2611 (period T2605) in segment 3B, and the selected scan line 208 is sequentially shifted one row at a time in the y-direction each time the row shift signal 2611 rises. The row shift signal 2611 is transmitted 512 times in segment 3B. In this example, the length of the period T2604 is still shorter than the length of the period T2605. The grst signal rises as a frame reset signal 2620 in segment 3C, and the process subsequently advances to the next frame.

FIG. 12(B) is a timing chart for shifts in the x-direction. The pixel column position indicated in FIG. 12(B) denotes the rightmost data line 209 among the ten selected data lines 209 for the first modulation area 806A. The value in parentheses indicates the leftmost data line 209 among the ten data lines 209 selected for the second modulation area 806B.

To begin with, all data lines 209 are deselected by reset signals 2621A and 2621B rising in the drst1 and drst2 signals. Next, while dstp1 is High in segment 3B-1, the dclk1 signal rises once as a row shift signal 2631A, selecting ten columns toward the left from data line 209-400. Further, while dstp2 is High in segment 3B-1, the dclk2 signal rises once as a row shift signal 2631B, selecting ten columns toward the right from data line 209-401. The rising start timing is the same for dstp1 and dstp2 and coincides with the start time of segment 3B-1. Therefore, the rising start timing of dstp1 and dstp2 for the $44^{th}$ row is the start time of segment 3B. The data lines 209 are shifted leftward ten columns each time the row shift signal 2631A rises, selecting data lines 209 for ten new columns, and the data lines 209 are shifted rightward ten columns each time the row shift signal 2631B rises, selecting data lines 209 for ten new columns. One row of modulation data is inputted in the first modulation area 806A through 26 shift signals in the dclk1 and dclk2. The drst1 and drst2 signals rise in segment 3B-2 as respective column reset signals 2621A and 2621B, deselecting the data lines for all columns.

According to the same calculation described in the preferred embodiment, the time required for segment 3A is 0.88 μs, the time required for segment 3C is 300 μs, the time required for segment 3B-1 is 2.08 μs, and the time required for segment 3B-2 is 0.3 μs. Hence, the time of one frame is equivalent to (time of segment 3A)+(time of segment 3B-1+time of segment 3B-2)×512+(time of segment 3C)=1510 μs, and the frame rate in this variation is 670 Hz.

By performing partial driving after dividing the display area into the first and second modulation areas 806A and 806B, the frame rate can be improved from 420 Hz to 670 Hz, thereby reducing fluctuations in the liquid crystal while achieving high image quality. Further, this variation does not require start position selection circuits or other special circuitry for partial driving of the first and second modulation areas 806A and 806B from the borderline 804 toward the left and right edges, thereby achieving high image quality through a simple construction.

In the second variation described above, the scanning circuits 203 and 204 sequentially shift the selected scan line 208 from the 208-1, serving as a prescribed scan line shift start position in the modulation area, based on the row shift signals 2610 and 2611, serving as scan line shift signals, and return the selected scan line 208 to the scan line shift start position based on the frame reset signal 2620, serving as a scan line reset signal. The multiplexer circuit 212A sequentially shifts the selected data lines 209 from data lines 209-391 through 209-400, serving as a first data line shift start position in the first modulation area 806A, based on the row shift signal 2631A, serving as a first data line shift signal, and return the selected data lines 209 to the first data line shift start position based on the reset signal 2621A, serving as a first data line reset signal. The multiplexer circuit 212B sequentially shifts the selected data lines 209 from data lines 209-401 through 209-410, serving as a second data line shift start position in the first modulation area 806B, based on the row shift signal 2631B, serving as a second data line shift signal, and return the selected data lines 209 to the second data line shift start position based on the reset signal 2621B, serving as a second data line reset signal. The first data line shift start position (data lines 209-391 through 209-400) are positioned inside the first modulation area 806A, with data line 209-400 being the data line 209 closest to the borderline 804. Similarly, the second data line shift start position (data lines 209-401 through 209-410) are positioned inside the second modulation area 806B, with the data line 209-401 being the data line 209 positioned closest to the borderline 804. The display area selection circuit 42 selects a display area 503 in the modulation area 206 that includes the borderline 804. The display area 503 includes the first and second display areas 503A and 503B positioned respectively in the first and second modulation areas 806A and 806B. The display start positions in the display area 503 are defined by the scan line 208-45, serving as a single scan line start position, the first data line shift start position (209-391 through 209-400), and the second data line shift start position (209-401 through 209-410). The display end positions in the display area 503 are defined by a single scan line display end position 208-556, data lines 209-141 through 209-150, serving as the first data line display end position in the first display area 503A, and data lines 209-651 through 209-660, serving as the second data line display end position in the second display area 503B. The drive circuit 201 sequentially generates row shift signals 2610 and 2611 for shifting the selected scan line 208 from the scan line shift start position to the scan line shift end position via a scan line display start position. The drive circuit 201 sequentially generates the row shift signal 2631A for shifting selected data lines in the first modulation area 806A from the first data line shift start position to the first data line display end position. After the position of the selected data lines reaches the first data line display end position, the drive circuit 201 halts generation of the row shift signal 2631A and generates the reset signal 2621A to return the position of the selected data lines to the first data line shift start position. The drive circuit 201 also sequentially generates the row shift signal 2631B for shifting the selected data lines in the second modulation area 806B from the second data line shift start position to the second data line display end position. After the position of the selected data lines reaches the second data line display end position, the drive circuit 201 halts generation of the row shift signal 2631B and generates the reset signal 2621B to return the position of the selected data lines to the second data line shift start position. When the selected scan line 208 reaches the scan line display end position, the selected data lines 209 in the first modulation area 806A reach the first data line display end position, and the selected data lines 209 in the second modulation area 806B reach the second data line display end position, the drive circuit 201 halts generation of the row shift signal 2611 and generates the frame reset signal 2620 to return the selected scan line 208 to the scan line shift start position. The drive circuit 201 sets the period T2604 of the row shift signal 2610 generated when the selected scan line 208 is between the scan line shift start position and the scan line display start position shorter than the period T2605 of the row shift signal 2611 generated while the selected scan line 208 is between the scan line display start position and the scan line display end position. The area between the $45^{th}$ row and the $556^{th}$ row and between the $145^{th}$ column and the $400^{th}$ column functions as the first display area, and the region between the $45^{th}$ row and the $556^{th}$ row and between the $401^{st}$ column and the $656^{th}$ column functions as the second display area.

Next, partial driving for an asymmetric display will be described. In this example, the display area is offset 64 pixels leftward from the symmetric display area described above. In other words, the non-display areas 501 and 505 in FIG. 11 are the same as in the preferred embodiment, but the non-display area 502 has a width W502 of 80 pixels, and the non-display area 504 has a width W504 of 208 pixels. The first display area 503A is composed of 320×512 pixels between the $81^{st}$ column and $400^{th}$ column and between the $45^{th}$ row and $556^{th}$ row. The second display area 503B is composed of 192×512 pixels between the $401^{st}$ column and $592^{nd}$ column and between the $45^{th}$ row and $556^{th}$ row. Hence, the width W503A is 320 pixels, while the width W503B is 192 pixels.

One frame is divided into the following three time segments, as in the symmetric display.

As shown in FIG. 12(A), one frame is divided into the following three time segments.

[Segment 3A] 44 rows from the $1^{st}$ row to the $44^{th}$ row (non-display area 501)

[Segment 3B] 512 rows from the $45^{th}$ row to the $556^{th}$ row (non-display area 502, display area 503, and non-display area 504)

[Segment 3C] 44 rows from the $557^{th}$ row to the $600^{th}$ row (non-display area 505)

However, segment 3B is divided into the following two time segments that differ from the symmetric display example.

[Segment 3B'-1] 320 columns from the $400^{th}$ column to the $81^{st}$ column and 200 columns from the $401^{st}$ column to the $600^{th}$ column for a total of 520 columns (display area 503)

[Segment 3B'-2] 80 columns from the $1^{st}$ column to the $80^{th}$ column and 200 columns from the $601^{st}$ column to the $800^{th}$ column (non-display areas 502 and 504)

Figure 13A:
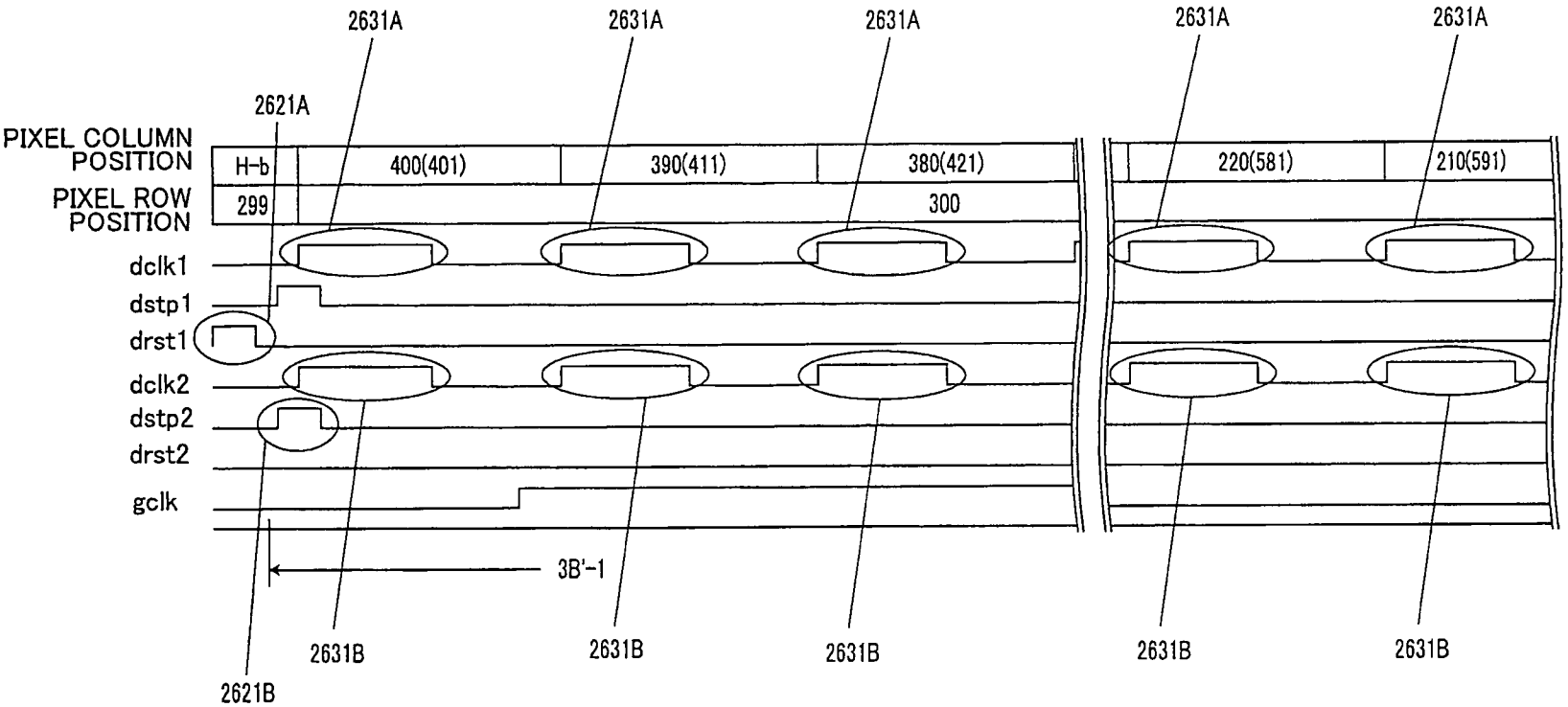
FIG. 13(A) is a timing chart in an asymmetric display according to the second variation.
Figure 13B:
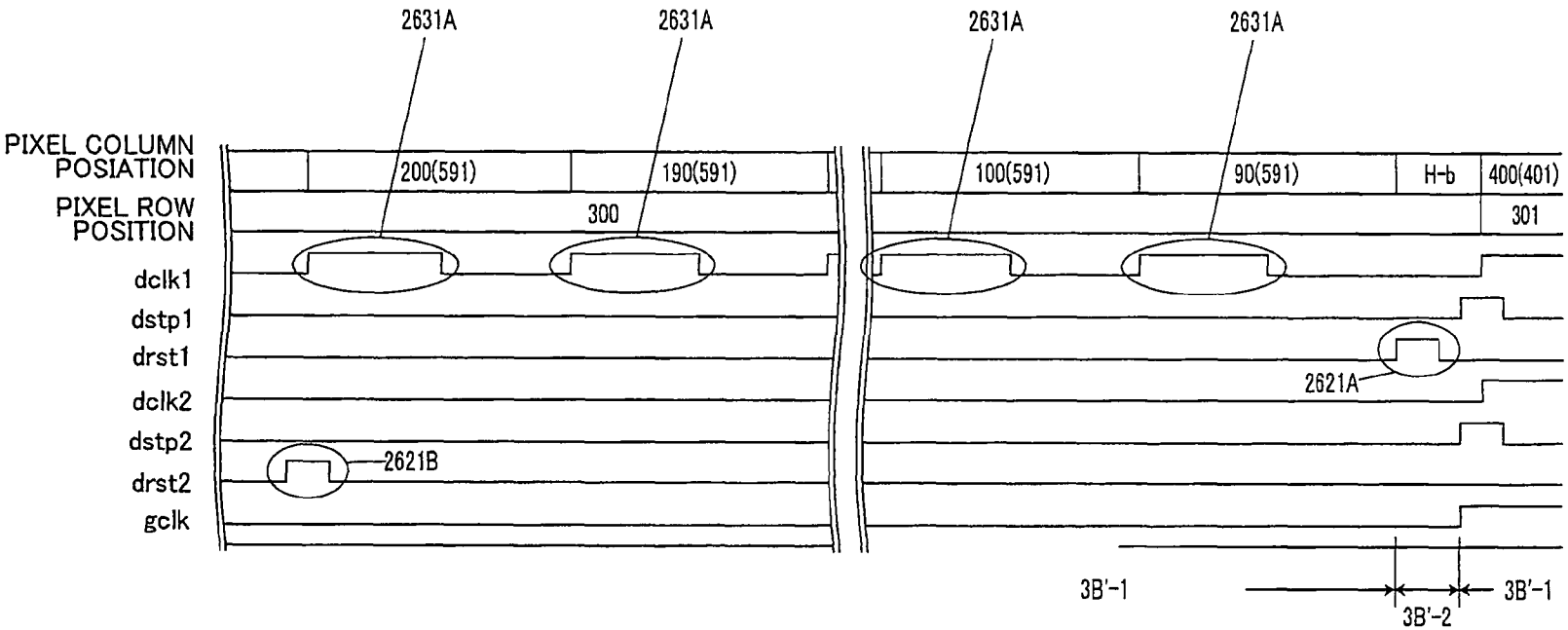
FIG. 13(B) is a timing chart in the asymmetric display according to the second variation.

The timing chart for the y-direction is identical to that shown in FIG. 12(A). FIGS. 13(A) and 13(B) show the timing chart for the x-direction. FIGS. 13(A) and 13(B) are continuous in time, with the right edge of the timing chart in FIG. 13(A) connected to the left edge of the timing chart in FIG. 13(B). In segment 3B'-1, the row shift signal 2631A rising in dclk1 shifts the selected data lines from the $400^{th}$ column to the $81^{st}$ column, i.e., leftward from the borderline 804, while the row shift signal 2631B rising in dclk2 shifts the selected data lines from the $401^{st}$ column to the $600^{th}$ column, i.e., rightward from the borderline 804. Modulation data is written to the second modulation area 806B by repeatedly setting the row shift signal 2631B in dclk2 to High 20 times, after which the reset signal 2621B is set to High in drst2. On the other hand, modulation data is written to the first modulation area 806A by repeatedly setting the row shift signal 2631A in the dclk1 to High 32 times. In segment 3B'-2, the reset signal 2621A rises in drst1.

Calculation of the frame rate for an asymmetric display is identical to that for the symmetric display, except the time required for segment 3B'-1. In segment 3B'-1, the row shift signal 2631A rises 32 times in dclk1. Since the period of the row shift signal 2631A is equivalent to the charge accumulation time of 80 ns, the time required for segment 3B'-1 is 32×80 ns=2.56 μs. Accordingly, the time of one frame is 1760 μs, and the frame rate is 570 Hz.

As described above, a high frame rate can be obtained in an asymmetric display through partial driving in the first and second modulation areas 806A and 806B. Further, since modulation data is simultaneously inputted into two pixels 215 positioned closest to the borderline 804 and on each side thereof, this method prevents display abnormalities around the borderline 804.

In an asymmetric display, data lines 209-391 through 209-400 function as the first data line shift start position and display start position; data lines 209-401 through 209-410 function as the second data line shift start position and display start position; the scan line 208-1 functions as the scan line shift start position; the scan line 208-45 functions as the scan line display start position; data lines 209-81 through 209-90 function as the first data line display end position; data lines 209-591 through 209-600 function as the second data line display end position; and the scan line 208-556 functions as the scan line display end position. Further, the area between the $45^{th}$ row and $556^{th}$ row and between the $81^{st}$ column and $400^{th}$ column functions as the first display area, while the area between the $45^{th}$ row and $556^{th}$ row and between the $401^{st}$ column and $592^{nd}$ column functions as the second display area.

(Third Variation)

Figure 14:
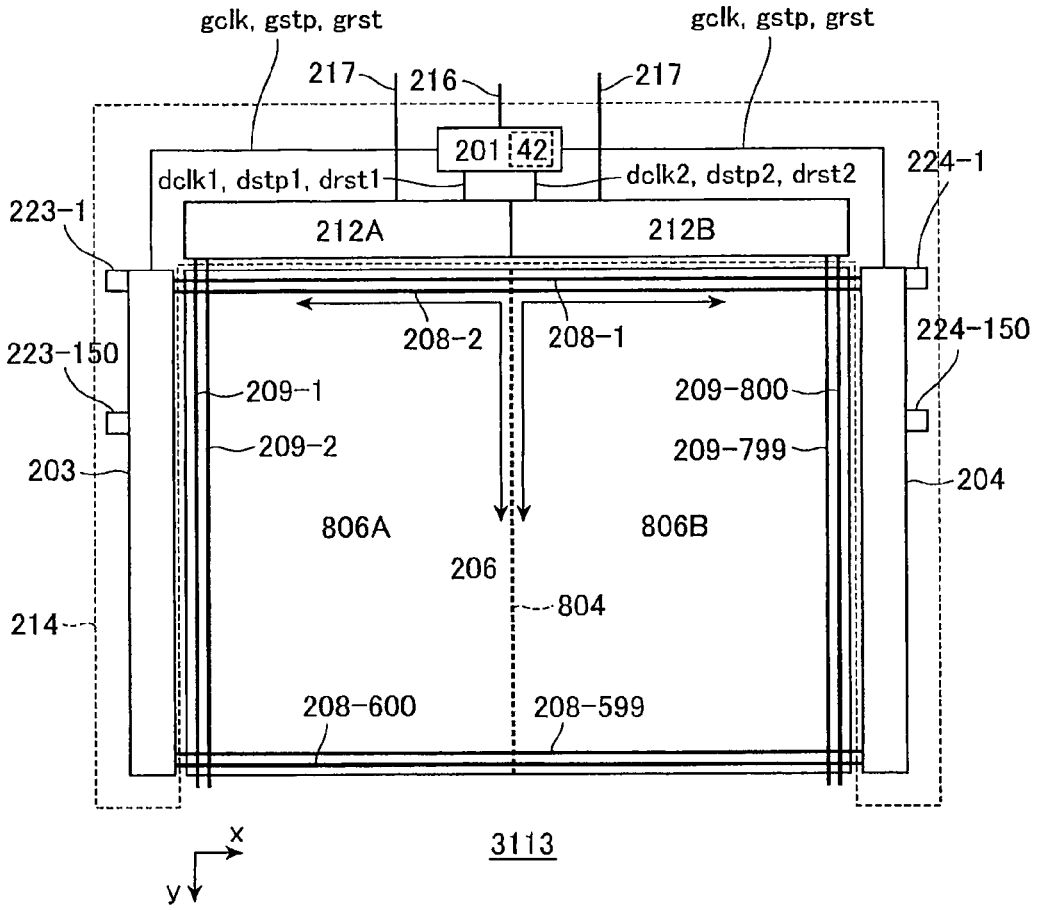
FIG. 14 is a view showing a circuit substrate according to a third variation.

As shown in FIG. 14, a circuit substrate 3113 may be used in place of the circuit substrate 2113. The circuit substrate 3113 is identical to the circuit substrate 2113 according to the second embodiment, except the scanning circuit 203 is provided with the start position selection circuits 223-1 and 223-150 and the scanning circuit 204 is provided with the start position selection circuits 224-1 and 224-150.

As in the first variation of the embodiment, when the drive circuit 201 specifies either the start position selection circuits 223-1 and 224-1 or the start position selection circuits 223-150 and 224-150, the scanning circuits 203 and 204 begin shifting the scan line 208 from the position selected by the specified start position selection circuit. In this example, the display area selection circuit 42 of the control unit 4 selects a display area that includes at least part of the borderline 804. In other words, the display area selection circuit 42 selects a display area including at least part of the data line 209-400 and at least part of the data line 209-401.

A display area 503 having 320×240 pixels such as that described in the first variation can be used as an example of a symmetric display. Specifically, the first display area 503A in FIG. 11 has 160×240 pixels between columns 241 and 400 and rows 181 and 420. Accordingly, the widths W503A and W503B are both 160 pixels worth. One frame is divided into the following three segments.

[Segment 4A] 149 rows from the $1^{st}$ row to the $149^{th}$ row (portion of the non-display area 501 prior to selection by the start position selection circuits 223-150 and 224-150), and 31 rows from the $150^{th}$ row to the $180^{th}$ row (portion of the non-display area 501 after selection by the start position selection circuits 223-150 and 224-150)

[Segment 4B] 240 rows from the $181^{st}$ row to the $420^{th}$ row (non-display area 502, display area 503, and non-display area 504)

[Segment 4C] 180 rows from the $421^{st}$ row to the $600^{th}$ row (non-display area 505)

The following two time segments are repeated 240 times in segment 4B.

[Segment 4B-1] 160 columns from the $400^{th}$ column to the $241^{st}$ column and 160 columns from the $401^{st}$ column to the $560^{th}$ column for a total of 320 columns (display area 503)

[Segment 4B-2] 240 columns from the $1^{st}$ column to the $240^{th}$ column (non-display area 502) and 240 columns from the $561^{st}$ column to the $800^{th}$ column (non-display area 504)

Figure 15A:
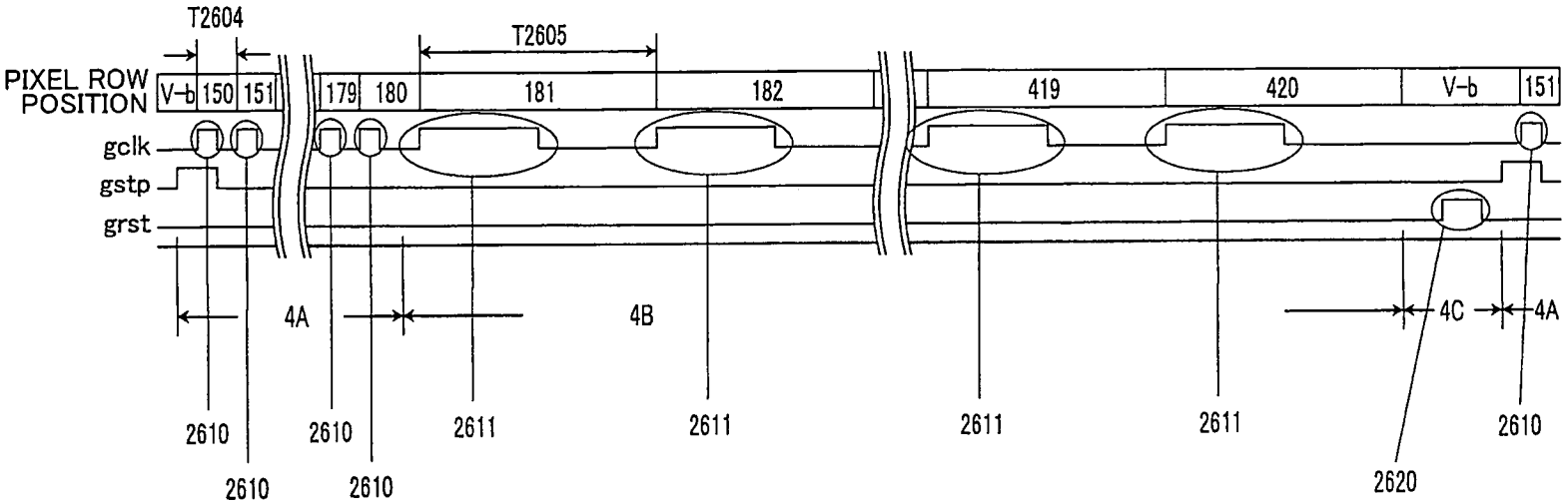
FIG. 15(A) is a timing chart for shifts with respect to rows in a symmetric display according to the third variation.
Figure 15B:
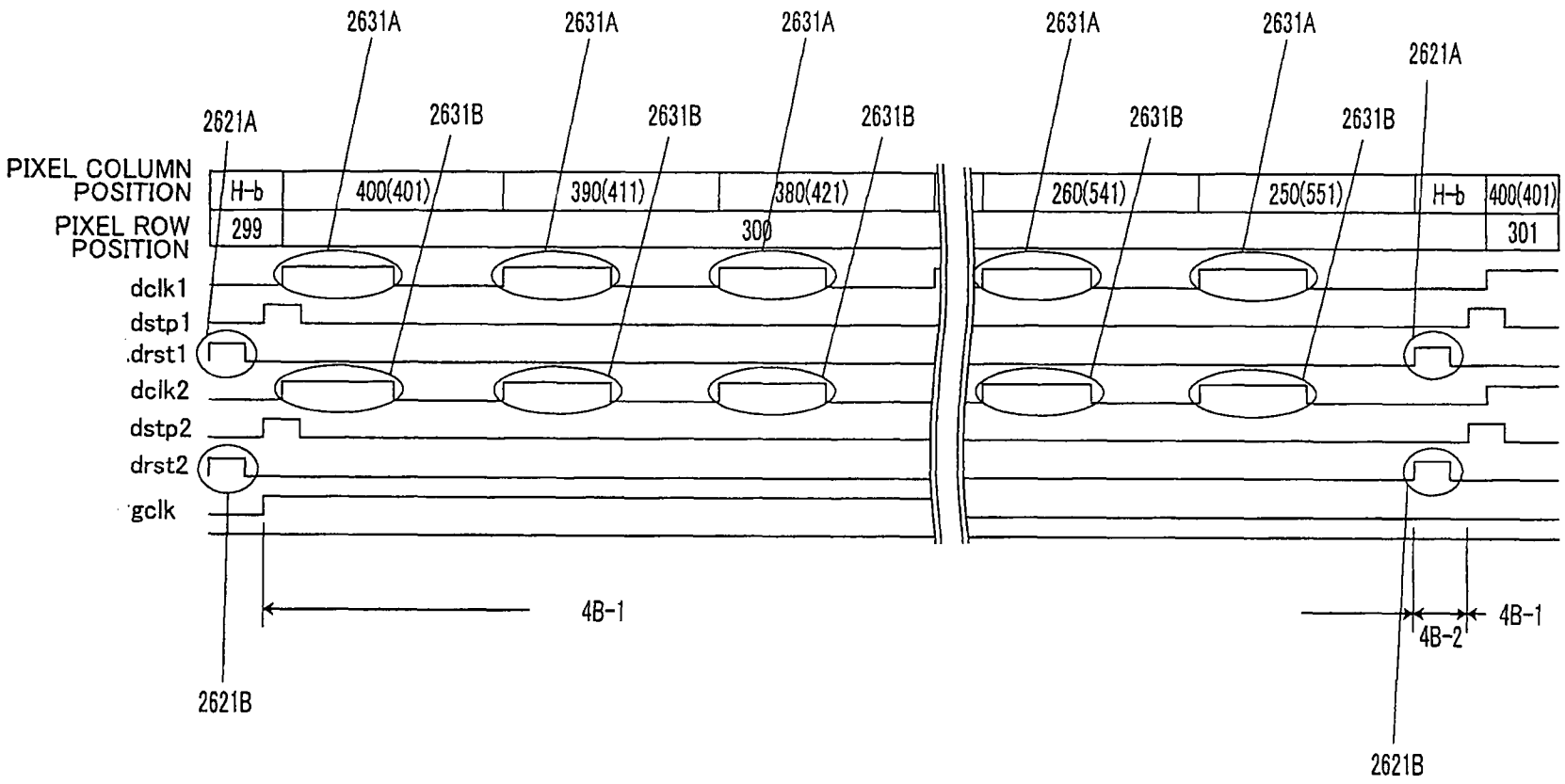
FIG. 15(B) is a timing chart for shifts with respect to columns in the symmetric display according to the third variation.

As shown in FIG. 15(A), shifts in the y-direction are identical to those in the first variation shown in FIG. 9(A), and segments 4A, 4B, and 4C correspond to segments 2A, 2B, and 2C. Further, as shown in FIG. 15(B), shifts in the x-direction are identical to the symmetric display example in the second variation shown in FIG. 12(B). However, while each of the row shift signals 2631A and 2631B are transmitted 26 times in FIG. 12(B), each of the row shift signals 2631A and 2631B are transmitted 16 times in this variation.

The time required for segment 4C is 300 μs; the time required for segment 4A is 0.62 μs; the time required for segment 4B-1 is 1.28 μs; and the time required for segment 4B-2 is 0.3 μs. The frame rate for a symmetric display in this variation is 1500 Hz, as described above.

In a symmetric display, data lines 209-391 through 209-400 function as the first data line shift start position and display start position; data lines 209-401 through 209-410 function as the second data line shift start position and display start position; the scan line 208-150 functions as the scan line shift start position; the scan line 208-181 functions as the scan line display start position; data lines 209-241 through 209-250 function as the first data line display end position; data lines 209-551 through 209-560 function as the second data line display end position; and the scan line 208-420 functions as the scan line display end position. Further, the area between the rows 181 and 420 and between columns 241 and 400 functions as the first display area, while the area between rows 181 and 420 and between columns 401 and 560 functions as the second display area.

Next, an example of an asymmetric display will be described, wherein the display area is shifted 60 pixels leftward from the display area of 320×240 pixels in the symmetric display described above. The first display area 503A is composed of 220×240 pixels between the $181^{st}$ column and the $400^{th}$ column and between the $181^{st}$ row and the $420^{th}$ row. The second display area 503B is composed of 100×240 pixels between the $401^{st}$ column and the $500^{th}$ column and between the $181^{st}$ row and the $420^{th}$ row. In this example, the width W502 in FIG. 11 is 180 pixels, the width W504 is 300 pixels, the width W503A is 220 pixels, and the width W5038 is 100 pixels.

As in the symmetric display shown in FIG. 15(A), one frame can be divided into segments 4A, 4B, and 4C. However, the following two segments are repeated 240 times in segment 4B in place of segments 4B-1 and 4B-2.

[Segment 4B'-1] 220 columns from the $400^{th}$ column to the $180^{th}$ column and 100 columns from the $401^{st}$ column to the $500^{th}$ column for a total of 320 columns (display area 503)

[Segment 4B'-2] 180 columns from the $1^{st}$ column to the $180^{th}$ column (non-display area 502) and 300 columns from the $501^{st}$ column to the $800^{th}$ column (non-display area 504)

Figure 16A:
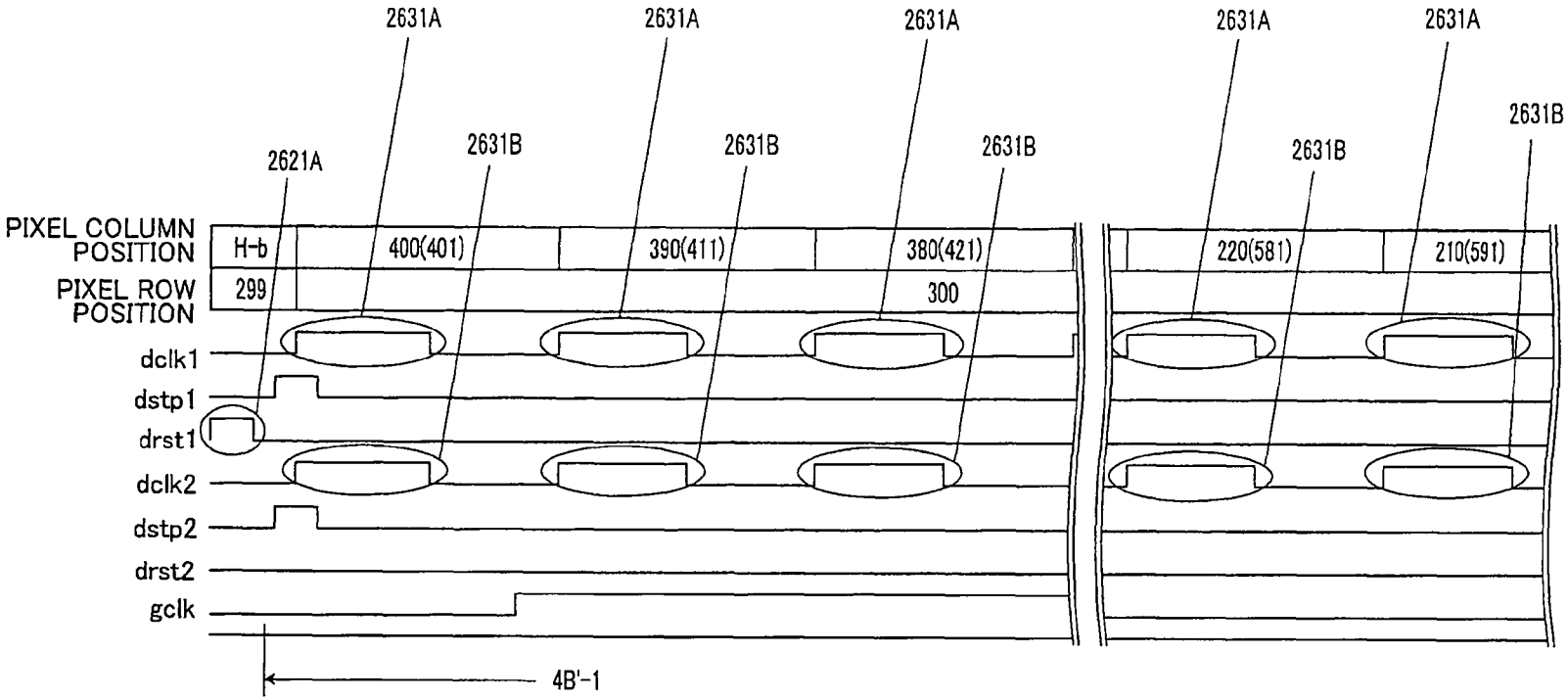
FIG. 16(A) is a timing chart in an asymmetric display according to the third variation.
Figure 16B:
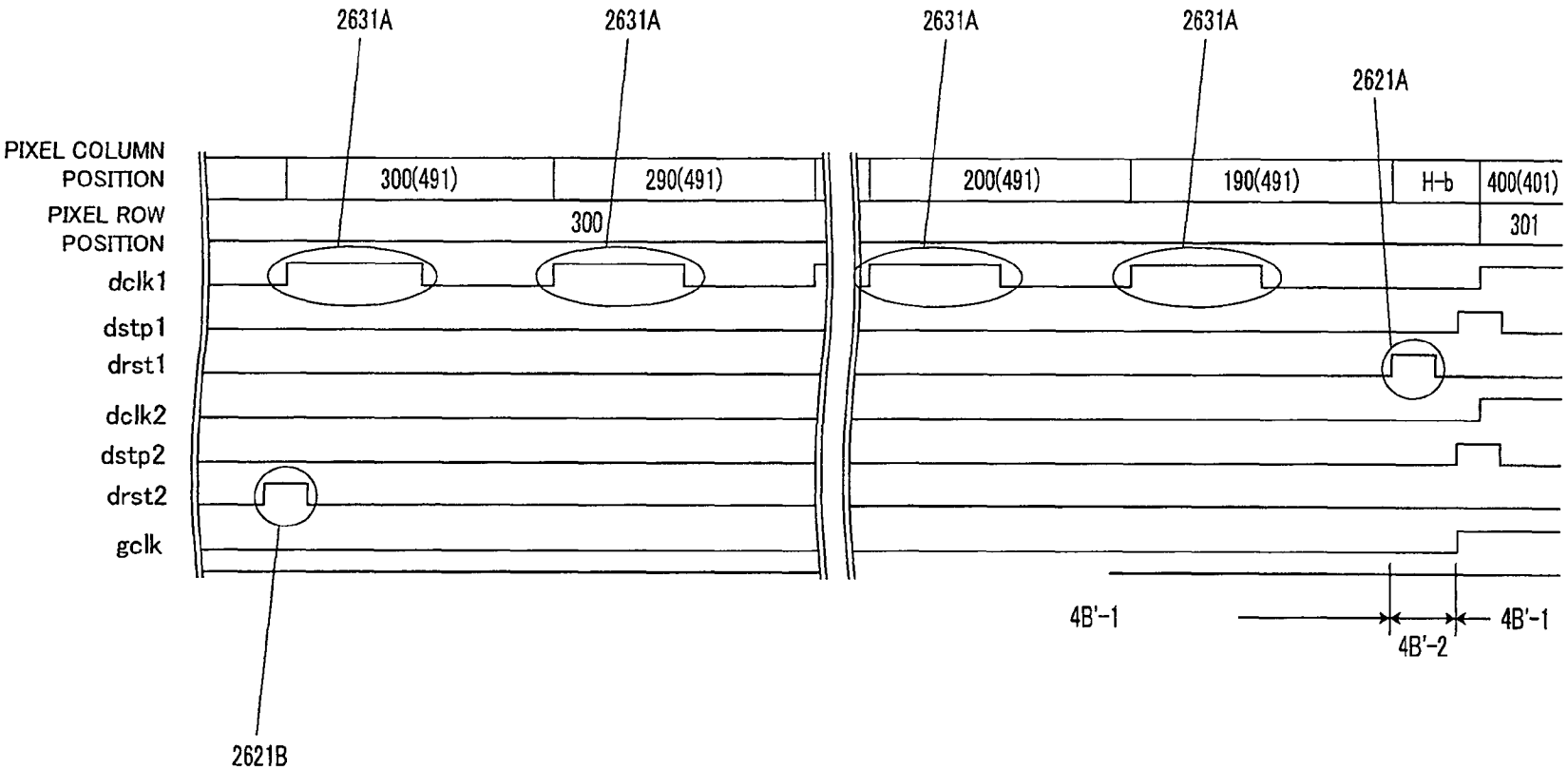
FIG. 16(B) is a timing chart in the asymmetric display according to the third variation.

FIGS. 16(A) and 16(B) show a timing chart for the x-direction, where the left end of the timing chart in FIG. 16(B) is continuous in time with the right end of the timing chart in FIG. 16(A). As in the asymmetric display of the second variation (FIGS. 13(A) and 13(B)), the multiplexer circuits 212A and 212B are reset at different timings in the timing chart of this variation. Specifically, after the multiplexer circuit 212A has selected data lines 209-181 through 209-190 in segment 4B'-1 through the $22^{nd}$ rise of the row shift signal 2631A, the reset signal 2621A rises. Further, after the multiplexer circuit 212B has selected data lines 209-491 through 209-500 through the $10^{th}$ rise of the row shift signal 2631B, the reset signal 2621B rises. After being reset, the multiplexer circuit 212B enters a wait state until the multiplexer circuit 212A is reset (until the reset signal 2621A rises).

The calculation of frame rate is identical to that for a symmetric display, except for the segment 4B'-1. Since the row shift signal 2631A is transmitted 22 times in segment 4B'-1 and the period of the row shift signal 2631A is equivalent to the charge accumulation time of 80 ns, the required time for segment 4B'-1 is 22×80 ns=1.76 μs. Accordingly, the time of one frame is 790 μs, and the frame rate is 1270 Hz. Hence, this variation can improve the frame rate from 420 Hz for a full-screen display to 1270 Hz, while achieving high-quality images.

In the asymmetric display, data lines 209-391 through 209-400 function as the first data line shift start position and display start position; data lines 209-401 through 209-410 function as the second data line shift start position and display start position; the scan line 208-150 functions as the scan line shift start position; the scan line 208-181 functions as the scan line display start position; data lines 209-181 through 209-190 function as the first data line display end position; data lines 209-491 through 209-500 function as the second data line display end position; and the scan line 208-420 functions as the scan line display end position. Further, the area between rows 181 and 420 and between columns 181 and 400 functions as the first display area, while the area between rows 181 and 420 and between columns 401 and 500 functions as the second display area.

As described above, by dividing the modulation area 206 into the areas 806A and 806B and performing partial driving with the start position selection circuits 223-1, 223-150, 224-1, and 224-150, phase modulation can be achieved at a higher frame rate, whether the display is symmetric or asymmetric.

While the LCoS spatial light modulator 2 according to the present invention has been described in detail with reference to specific embodiments thereof, it would be apparent to those skilled in the art that many modifications and variations may be made therein without departing from the spirit of the invention, the scope of which is defined by the attached claims. For example, the scanning circuits 203 and 204 may be divided into a plurality of circuits, and the modulation area 206 may be divided along the direction of rows as well as the direction of columns. Further, the modulation area 206 may be divided into three or more areas along the direction of rows or columns, rather than just being split in half. In such a case, modulation data should be inputted simultaneously into pixels nearest the borderline and their counterparts on the other side of the borderline. For example, for one borderline, modulation data may be inputted simultaneously into pairs of pixels straddling the borderline and in closest proximity thereto immediately after starting a frame. For other borderlines, modulation data may be inputted simultaneously into pairs of pixels straddling the other borderline and in closest proximity thereto just before ending data input for a row in the two regions between which other borderline is located or just before ending the frame.

Further, while the pixels 215 form an active matrix circuit in the preferred embodiment, a simple matrix circuit may be used instead. While the display area selection circuit 42 is provided separately from the central processing unit 41 in the control unit 4 according to the preferred embodiment, the display area selection circuit 42 may be incorporated in the central processing unit 41. Further, instead of the display area selection circuit 42 of the control unit 4 selecting the display area for partial driving, the processing unit 31 of the drive unit 3 may make this selection. In this case, configuration data for display areas related to partial driving may be prerecorded in the drive unit 3 and drive signals may be generated based on this data when executing partial driving. As indicated by dotted lines in FIGS. 10 and 14, the display area selection circuit 42 may be provided in the drive circuit 201 and used to select the display area for partial driving. In this case, configuration data for display areas related to partial driving may be prerecorded in the drive circuit 201, and the display area selection circuit 42 may generate the drive signals (gclk, gstp, grst, dclk, dstp, drst, dclk1, dstp1, drst1, dclk2, dstp2, and drst2) used for implementing partial driving based on the prerecorded data.

While the display area is centered vertically in the modulation area in the preferred embodiment described above, a partial display area may be set in the top of the modulation area to obtain a higher frame rate. For example, the display area 503 can be set such that the length L501 of the non-display area 501 in FIG. 6 is less than the length L505 of the non-display area 505, making it possible to reduce the shift time from the shift start position to the display start position. Further, the display start position in this case may be set to the scan line for the first row or to a scan line selected by start position selection circuits, making it possible to eliminate the shift time from the shift start position to the display start position.

The data lines 209 and scan lines 208 in the circuit substrates 113, 1113, 2113, and 3113 may intersect obliquely rather than orthogonally.

It is also possible to select pixels sequentially in the circuit substrates 113, 1113, 2113, and 3113 without using the data lines 209 and scan lines 208.

INDUSTRIAL APPLICABILITY

The LCoS spatial light modulator according to the present invention is suitable for use in such fields as laser machining, optical tweezers, adaptive optics, various optical imaging systems, optical communications, aspheric lens inspection, pulse shape control for short-pulse lasers, and optical memory.

The invention claimed is:

1. An LCoS spatial light modulator comprising:

a plurality of pixel diodes that is arranged two-dimensionally and that defines a modulation area;

a signal generating circuit that generates a shift signal and a reset signal;

a pixel selection circuit that selects a pixel diode based on the shift signal and the reset signal and that inputs a data signal into the selected pixel;

a display area selection circuit that selects a desired display area from the modulation area; and a plurality of data lines and a plurality of scan lines that intersect the plurality of the data lines, each pixel diode being connected to one data line and one scan line, wherein the modulation area is divided into a plurality of divided modulation areas by at least one borderline, wherein the display area selection circuit selects a display area including at least part of at least one borderline from the modulation area, the selected display area including two divided display areas that are provided in two divided modulation areas disposed each side of the borderline, each divided display area including a corresponding display start position and a corresponding display end position, wherein for each of the plurality of divided modulation areas, the pixel selection circuit sequentially shifts a selection position of the pixel diode from a prescribed shift start position based on the shift signals and returns the selection position of the pixel diode toward the prescribed shift start position based on the reset signal, wherein for each of the at least two divided modulation areas corresponding to the at least two divided display areas, the signal generating circuit sequentially generates the shift signals for shifting the selection position of the pixel diode from the shift start position corresponding to the each of the at least two divided modulation areas toward a shift end position corresponding to the each of the at least two divided modulation areas via the display start position corresponding to the each of the at least two divided modulation areas, the signal generating circuit halting generation of the shift signals and generating the reset signal to return the selection position of the pixel diode to the shift start position after the selection position of the pixel diode reaches the display end position, wherein the signal generating circuit sets a period of each shift signal generated while the selection position of the pixel diode is between the shift start position and the display start position shorter than a period of each shift signal generated while the selection position of the pixel diode is between the display start position and the display end position, wherein the modulation area is divided into first and second divided modulation areas by one borderline, the one borderline being parallel to the data line, wherein the signal generating circuit generates first and second data line shift signals, a scan line shift signal, first and second data line rest signals, and a scan line reset signal, wherein the pixel selection circuit includes:

a scan line selection circuit that selects a scan line;

a first data line selection circuit that selects a data line in the first divided modulation area and that inputs data into the selected data line; and a second data line selection circuit that selects a data line in the second divided modulation area and that inputs data into the selected data line, wherein the scan line selection circuit sequentially shifts a selection position of the scan line from a prescribed scan line shift start position based on the scan line shift signals and returns the selection position of the scan line to the scan line shift start position based on the scan line reset signal, wherein the first data line selection circuit sequentially shifts a selection position of the data line from a first data line shift start position in the first modulation area and returns the selection position of the data line to the first data line shift start position based on the first data line reset signal, wherein the second data line selection circuit sequentially shifts a selection position of the data line from a second data line shift start position in the second modulation area and returns the selection position of the data line to the second data line shift start position based on the second data line reset signal, wherein the first data line shift start position is a selection position of a data line that is provided in the first modulation area and that is most adjacent to the borderline, the second data line shift start position is a selection position of a data line that is provided in the second modulation area and that is most adjacent to the borderline, wherein the display area selection circuit selects the display area that includes at least part of one borderline from the modulation area, the display area having first and second divided display areas provided in the first and second divided modulation areas, wherein the display area includes, as the display start position, a scan line display start position, the first data line shift start position, and the second data line shift start position, wherein the display area includes, as the display end position, a scan line display end position, a first data line display end position provided in the first divided display area, and a second data line display end position provided in the second divided display area, wherein the signal generating circuit sequentially generates the scan line shift signals for shifting the selection position of the scan line from the scan line shift start position to the scan line display end position via the scan line display start position, and the signal generating circuit sequentially generating first data shift signals for shifting the selection position of the data line in the first divided modulation area from the first data line shift start position to the first data line display end position, the signal generating circuit halting generation of the first data line shift signals and generating the first data line reset signal to return the selection position of the data line to the first data line shift start position after the selection position of the data line reaches the first data line display end position, the signal generating circuit sequentially generating second data shift signals for shifting the selection position of the data line in the second divided modulation area from the second data line shift start position to the second data line display end position, the signal generating circuit halting generation of the second data line shift signals and generating the second data line reset signal to return the selection position of the data line to the second data line shift start position after the selection position of the data line reaches the second data line display end position, the signal generating circuit halting generation of the scan line shift signals and generating the scan line reset signal to return the selection position of the scan line to the scan line shift start position after the selection position of the scan line reaches the scan line display end position, after the selection position of the data line in the first divided modulation area reaches the first data line display end position, and after the selection position of the data line in the second divided modulation area reaches the second data line display end position, and wherein the signal generating circuit sets a period of each scan line shift signal generated while the selection position of the scan line is between the scan line shift start position and the scan line display start position shorter than a period of each scan line shift signal generated while the selection position of the scan line is between the scan line display start position and the scan line display end position.

2. The LCoS spatial light modulator according to claim 1, wherein the pixel selection circuit sets the shift start positions with respect to the two neighboring divided modulation areas as pixel diodes that are most adjacent to the borderline of the two neighboring divided modulation areas.

3. The LCoS spatial light modulator according to claim 1, further comprising a start position selection circuit that specifies at least one shift start position different from the prescribed shift start position, wherein when the signal generation circuit designates the start position selection circuit, the pixel selection circuit starts shifting the selection position of the pixel diode from the shift start position specified by the start position selection circuit.

4. The LCoS spatial light modulator according to claim 1, wherein the scan line selection circuit includes a start position selection circuit that specifies a scan line shift start position different from the prescribed scan line shift start position, wherein when the start signal generation circuit designates the start position selection circuit, the scan line selection circuit starts shifting the selection position of the scan line from the scan line shift start position specified by the start position selection circuit.

5. The LCoS spatial light modulator according to claim 2, further comprising a start position selection circuit that specifies at least one shift start position different from the prescribed shift start position, wherein when the signal generation circuit designates the start position selection circuit, the pixel selection circuit starts shifting the selection position of the pixel diode from the shift start position specified by the start position selection circuit.

6. The LCoS spatial light modulator according claim 2, further comprising a plurality of data lines and a plurality of scan lines that intersect the plurality of the data lines, each pixel diode being connected to one data line and one scan line, wherein the modulation area is divided into first and second divided modulation areas by one borderline, the one borderline being parallel to the data line, wherein the signal generating circuit generates first and second data line shift signals, a scan line shift signal, first and second data line rest signals, and a scan line reset signal, wherein the pixel selection circuit includes:

a scan line selection circuit that selects a scan line;

a first data line selection circuit that selects a data line in the first divided modulation area and that inputs data into the selected data line; and a second data line selection circuit that selects a data line in the second divided modulation area and that inputs data into the selected data line, wherein the scan line selection circuit sequentially shifts a selection position of the scan line from a prescribed scan line shift start position based on the scan line shift signals and returns the selection position of the scan line to the scan line shift start position based on the scan line reset signal, wherein the first data line selection circuit sequentially shifts a selection position of the data line from a first data line shift start position in the first modulation area and returns the selection position of the data line to the first data line shift start position based on the first data line reset signal, wherein the second data line selection circuit sequentially shifts a selection position of the data line from a second data line shift start position in the second modulation area and returns the selection position of the data line to the second data line shift start position based on the second data line reset signal, wherein the first data line shift start position is a selection position of a data line that is provided in the first modulation area and that is most adjacent to the borderline, the second data line shift start position is a selection position of a data line that is provided in the second modulation area and that is most adjacent to the borderline, wherein the display area selection circuit selects the display area that includes at least part of one borderline from the modulation area, the display area having first and second divided display areas provided in the first and second divided modulation areas, wherein the display area includes, as the display start position, a scan line display start position, the first data line shift start position, and the second data line shift start position, wherein the display area includes, as the display end position, a scan line display end position, a first data line display end position provided in the first divided display area, and a second data line display end position provided in the second divided display area, wherein the signal generating circuit sequentially generates the scan line shift signals for shifting the selection position of the scan line from the scan line shift start position to the scan line display end position via the scan line display start position, and the signal generating circuit sequentially generating first data shift signals for shifting the selection position of the data line in the first divided modulation area from the first data line shift start position to the first data line display end position, the signal generating circuit halting generation of the first data line shift signals and generating the first data line reset signal to return the selection position of the data line to the first data line shift start position after the selection position of the data line reaches the first data line display end position, the signal generating circuit sequentially generating second data shift signals for shifting the selection position of the data line in the second divided modulation area from the second data line shift start position to the second data line display end position, the signal generating circuit halting generation of the second data line shift signals and generating the second data line reset signal to return the selection position of the data line to the second data line shift start position after the selection position of the data line reaches the second data line display end position, the signal generating circuit halting generation of the scan line shift signals and generating the scan line reset signal to return the selection position of the scan line to the scan line shift start position after the selection position of the scan line reaches the scan line display end position, after the selection position of the data line in the first divided modulation area reaches the first data line display end position, and after the selection position of the data line in the second divided modulation area reaches the second data line display end position, wherein the signal generating circuit sets a period of each scan line shift signal generated while the selection position of the scan line is between the scan line shift start position and the scan line display start position shorter than a period of each scan line shift signal generated while the selection position of the scan line is between the scan line display start position and the scan line display end position.

7. The LCoS spatial light modulator according to claim 6, wherein the scan line selection circuit includes a start position selection circuit that specifies a scan line shift start position different from the prescribed scan line shift start position, wherein when the start signal generation circuit designates the start position selection circuit, the scan line selection circuit starts shifting the selection position of the scan line from the scan line shift start position specified by the start position selection circuit.

8. An LCoS spatial light modulator comprising:

a plurality of pixel diodes that is arranged two-dimensionally and that defines a modulation area;

a signal generating circuit that generates a shift signal and a reset signal;

a pixel selection circuit that selects a pixel diode based on the shift signal and the reset signal and that inputs a data signal into the selected pixel;

a display area selection circuit that selects a desired display area from the modulation area; and a plurality of data lines and a plurality of scan lines that intersect the plurality of the data lines, each pixel diode being connected to one data line and one scan line, wherein the modulation area is divided into a plurality of divided modulation areas by at least one borderline, wherein the display area selection circuit selects a display area including at least part of at least one borderline from the modulation area, the selected display area including two divided display areas that are provided in two divided modulation areas disposed each side of the borderline, each divided display area including a corresponding display start position and a corresponding display end position, wherein for each of the plurality of divided modulation areas, the pixel selection circuit sequentially shifts a selection position of the pixel diode from a prescribed shift start position based on the shift signals and returns the selection position of the pixel diode toward the prescribed shift start position based on the reset signal, wherein for each of the at least two divided modulation areas corresponding to the at least two divided display areas, the signal generating circuit sequentially generates the shift signals for shifting the selection position of the pixel diode from the shift start position corresponding to the each of the at least two divided modulation areas toward a shift end position corresponding to the each of the at least two divided modulation areas via the display start position corresponding to the each of the at least two divided modulation areas, the signal generating circuit halting generation of the shift signals and generating the reset signal to return the selection position of the pixel diode to the shift start position after the selection position of the pixel diode reaches the display end position, wherein the modulation area is divided into first and second divided modulation areas by one borderline, the one borderline being parallel to the data line, wherein the signal generating circuit generates first and second data line shift signals, a scan line shift signal, first and second data line rest signals, and a scan line reset signal, wherein the pixel selection circuit includes:

a scan line selection circuit that selects a scan line;

a first data line selection circuit that selects a data line in the first divided modulation area and that inputs data into the selected data line; and a second data line selection circuit that selects a data line in the second divided modulation area and that inputs data into the selected data line, wherein the scan line selection circuit sequentially shifts a selection position of the scan line from a prescribed scan line shift start position based on the scan line shift signals and returns the selection position of the scan line to the scan line shift start position based on the scan line reset signal, wherein the first data line selection circuit sequentially shifts a selection position of the data line from a first data line shift start position in the first modulation area and returns the selection position of the data line to the first data line shift start position based on the first data line reset signal, wherein the second data line selection circuit sequentially shifts a selection position of the data line from a second data line shift start position in the second modulation area and returns the selection position of the data line to the second data line shift start position based on the second data line reset signal, wherein the first data line shift start position is a selection position of a data line that is provided in the first modulation area and that is most adjacent to the borderline, the second data line shift start position is a selection position of a data line that is provided in the second modulation area and that is most adjacent to the borderline, wherein the display area selection circuit selects the display area that includes at least part of one borderline from the modulation area, the display area having first and second divided display areas provided in the first and second divided modulation areas, wherein the display area includes, as the display start position, a scan line display start position, the first data line shift start position, and the second data line shift start position, wherein the display area includes, as the display end position, a scan line display end position, a first data line display end position provided in the first divided display area, and a second data line display end position provided in the second divided display area, and wherein the signal generating circuit sequentially generates the scan line shift signals for shifting the selection position of the scan line from the scan line shift start position to the scan line display end position via the scan line display start position, and the signal generating circuit sequentially generating first data shift signals for shifting the selection position of the data line in the first divided modulation area from the first data line shift start position to the first data line display end position, the signal generating circuit halting generation of the first data line shift signals and generating the first data line reset signal to return the selection position of the data line to the first data line shift start position after the selection position of the data line reaches the first data line display end position, the signal generating circuit sequentially generating second data shift signals for shifting the selection position of the data line in the second divided modulation area from the second data line shift start position to the second data line display end position, the signal generating circuit halting generation of the second data line shift signals and generating the second data line reset signal to return the selection position of the data line to the second data line shift start position after the selection position of the data line reaches the second data line display end position, the signal generating circuit halting generation of the scan line shift signals and generating the scan line reset signal to return the selection position of the scan line to the scan line shift start position after the selection position of the scan line reaches the scan line display end position, after the selection position of the data line in the first divided modulation area reaches the first data line display end position, and after the selection position of the data line in the second divided modulation area reaches the second data line display end position.

* * * * *

UNITED STATES PATENT AND TRADEMARK OFFICE

CERTIFICATE OF CORRECTION

PATENT NO. : 8,525,772 B2
APPLICATION NO. : 12/448287
DATED : September 3, 2013
INVENTOR(S) : Hiroshi Tanaka et al.

It is certified that error appears in the above-identified patent and that said Letters Patent is hereby corrected as shown below:

On the Title Page Item (73)

Please correct the Assignee's address so that it appears on the Patent as follows:

~~Kamamatsu (JP)~~ Hamamatsu (JP)

Signed and Sealed this
Tenth Day of December, 2013

Margaret A. Focarino

Margaret A. Focarino
*Commissioner for Patents of the United States Patent and Trademark Office*